US007168431B2

(12) United States Patent
Li et al.

(10) Patent No.: US 7,168,431 B2
(45) Date of Patent: Jan. 30, 2007

(54) PARTIALLY REDUCED NANOPARTICLE ADDITIVES TO LOWER THE AMOUNT OF CARBON MONOXIDE AND/OR NITRIC OXIDE IN THE MAINSTREAM SMOKE OF A CIGARETTE

(75) Inventors: Ping Li, Richmond, VA (US); Firooz Rasouli, Midlothian, VA (US); Mohammad R. Hajaligol, Midlothian, VA (US)

(73) Assignee: Philip Morris USA Inc., Richmond, VA (US)

( * ) Notice: Subject to any disclaimer, the term of this patent is extended or adjusted under 35 U.S.C. 154(b) by 533 days.

(21) Appl. No.: 10/407,269

(22) Filed: Apr. 7, 2003

(65) Prior Publication Data

US 2004/0007241 A1 Jan. 15, 2004

Related U.S. Application Data

(60) Provisional application No. 60/371,729, filed on Apr. 12, 2002.

(51) Int. Cl.
*A24B 15/18* (2006.01)

(52) U.S. Cl. ..... 131/334; 131/364

(58) Field of Classification Search ..... 131/364, 131/334

See application file for complete search history.

(56) References Cited

U.S. PATENT DOCUMENTS

| | | | | |
|---|---|---|---|---|
| 2,003,690 | A * | 6/1935 | Lewton | 131/334 |
| 3,251,365 | A | 5/1966 | Keith et al. | |
| 3,720,214 | A | 3/1973 | Norman et al. | |
| 3,807,416 | A | 4/1974 | Hedge et al. | |
| 3,931,824 | A | 1/1976 | Miano et al. | |
| 4,091,822 | A | 5/1978 | Ihrig et al. | |
| 4,109,663 | A | 8/1978 | Maeda et al. | |
| 4,119,104 | A | 10/1978 | Roth | |
| 4,193,412 | A | 3/1980 | Heim et al. | |
| 4,195,645 | A | 4/1980 | Bradley, Jr. et al. | |
| 4,197,861 | A | 4/1980 | Keith | |
| 4,317,460 | A | 3/1982 | Dale et al. | |
| RE31,700 | E | 10/1984 | Yamaguchi | |
| 4,956,330 | A | 9/1990 | Elliot et al. | |
| 5,050,621 | A | 9/1991 | Creighton et al. | |
| 5,101,839 | A | 4/1992 | Jakob et al. | |
| 5,105,836 | A | 4/1992 | Gentry et al. | |
| 5,129,408 | A | 7/1992 | Jakob et al. | |
| 5,258,340 | A | 11/1993 | Augustine et al. | |
| 5,322,075 | A | 6/1994 | Deevi et al. | |
| 5,591,368 | A | 1/1997 | Fleischhauer et al. | |
| 5,598,868 | A | 2/1997 | Jakob et al. | |
| 5,934,289 | A | 8/1999 | Watkins et al. | |
| 6,053,176 | A | 4/2000 | Adams et al. | |
| 6,095,152 | A | 8/2000 | Beven et al. | |

FOREIGN PATENT DOCUMENTS

| | | | |
|---|---|---|---|
| CH | 609 217 | | 2/1979 |
| CN | 1312038 | * | 9/2001 |
| GB | 685822 | | 1/1953 |
| GB | 863287 | | 3/1961 |
| GB | 973854 | | 10/1964 |
| GB | 1104993 | | 3/1968 |
| GB | 1315374 | | 5/1973 |
| WO | WO 87/06104 | | 10/1987 |
| WO | WO 00/40104 | | 7/2000 |

OTHER PUBLICATIONS

PCT International Search Report issued in PCT Application US03/10646, Jul. 16, 2003.
Written Opinion for PCT/US03/10646 dated Mar. 1, 2004.
Notification of Transmittal of International Preliminary Examination Report for PCT/US03/10646 dated Aug. 16, 2004.

* cited by examiner

*Primary Examiner*—Dionne W. Mayes
(74) *Attorney, Agent, or Firm*—Buchanan Ingersoll & Rooney PC

(57) ABSTRACT

Cut filler compositions, cigarettes, methods for making cigarettes and methods for smoking cigarettes which involve the use of partially reduced nanoparticle additives capable of acting as an oxidant for the conversion of carbon monoxide to carbon dioxide and/or as a catalyst for the conversion of carbon monoxide to carbon dioxide are provided. The compositions, articles and methods of the invention can be used to reduce the amount of carbon monoxide and/or nitric oxide present in mainstream smoke. The partially reduced additive can be formed by partially reducing $Fe_2O_3$, to produce a mixture of various reduced forms such as $Fe_3O_4$, FeO and/or Fe, along with unreduced $Fe_2O_3$.

12 Claims, 25 Drawing Sheets

Flow Tube Reactor System

PARTIALLY REDUCED NANOPARTICLE ADDITIVES TO LOWER THE AMOUNT OF CARBON MONOXIDE AND/OR NITRIC OXIDE IN THE MAINSTREAM SMOKE OF A CIGARETTE

This application claims the benefit of Ser. No. 60/371,729 filed on Apr. 12, 2002.

FIELD OF INVENTION

The invention relates generally to lowering the amount of carbon monoxide and/or nitric oxide in the mainstream smoke of a cigarette during smoking. More specifically, the invention relates to cut filler compositions, cigarettes, methods for making cigarettes and methods for smoking cigarettes, which involve the use of a partially reduced additive, in the form of nanoparticles, which acts as a catalyst for the conversion of carbon monoxide to carbon dioxide and/or a catalyst for the conversion of nitric oxide to nitrogen.

BACKGROUND

Various methods for reducing the amount of carbon monoxide and/or nitric oxide in the mainstream smoke of a cigarette during smoking have been proposed. For example, British Patent No. 863,287 describes methods for treating tobacco prior to the manufacture of tobacco articles, such that incomplete combustion products are removed or modified during smoking of the tobacco article. This is said to be accomplished by adding a calcium oxide or a calcium oxide precursor to the tobacco. Iron oxide is also mentioned as an additive to the tobacco.

Cigarettes comprising absorbents, generally in a filter tip, have been suggested for physically absorbing some of the carbon monoxide, but such methods are usually not completely efficient. A cigarette filter for removing byproducts formed during smoking is described in U.S. Reissue Pat. No. RE 31,700, where the cigarette filter comprises dry and active green algae, optionally with an inorganic porous adsorbent such as iron oxide. Other filtering materials and filters for removing gaseous byproducts, such as hydrogen cyanide and hydrogen sulfide, are described in British Patent No. 973,854. These filtering materials and filters contain absorbent granules of a gas-adsorbent material, impregnated with finely divided oxides of both iron and zinc. In another example, an additive for smoking tobacco products and their filter elements, which comprises an intimate mixture of at least two highly dispersed metal oxides or metal oxyhydrates, is described in U.S. Pat. No. 4,193,412. Such an additive is said to have a synergistically increased absorption capacity for toxic substances in the tobacco smoke. British Patent No. 685,822 describes a filtering agent that is said to oxidize carbon monoxide in tobacco smoke to carbonic acid gas. This filtering agent contains, for example, manganese dioxide and cupric oxide, and slaked lime. The addition of ferric oxide in small amounts is said to improve the efficiency of the product.

The addition of an oxidizing reagent or catalyst to the filter has been described as a strategy for reducing the concentration of carbon monoxide reaching the smoker. The disadvantages of such an approach, using a conventional catalyst, include the large quantities of oxidant that often need to be incorporated into the filter to achieve considerable reduction of carbon monoxide. Moreover, if the ineffectiveness of the heterogeneous reaction is taken into account, the amount of the oxidant required would be even larger. For example, U.S. Pat. No. 4,317,460 describes supported catalysts for use in smoking product filters for the low temperature oxidation of carbon monoxide to carbon dioxide. Such catalysts include mixtures of tin or tin compounds, for example, with other catalytic materials, on a microporous support. Another filter for smoking articles is described in Swiss patent 609,217, where the filter contains tetrapyrrole pigment containing a complexed iron (e.g. haemoglobin or chlorocruorin), and optionally a metal or a metal salt or oxide capable of fixing carbon monoxide or converting it to carbon dioxide. In another example, British Patent No. 1,104,993 relates to a tobacco smoke filter made from sorbent granules and thermoplastic resin. While activated carbon is the preferred material for the sorbent granules, it is said that metal oxides, such as iron oxide, may be used instead of, or in addition to the activated carbon. However, such catalysts suffer drawbacks because under normal conditions for smoking, catalysts are rapidly deactivated, for example, by various byproducts formed during smoking and/or by the heat. In addition, as a result of such localized catalytic activity, such filters often heat up during smoking to unacceptable temperatures.

Catalysts for the conversion of carbon monoxide to carbon dioxide are described, for example, in U.S. Pat. Nos. 4,956,330 and 5,258,430. A catalyst composition for the oxidation reaction of carbon monoxide and oxygen to carbon dioxide is described, for example, in U.S. Pat. No. 4,956,330. In addition, U.S. Pat. No. 5,050,621 describes a smoking article having a catalytic unit containing material for the oxidation of carbon monoxide to carbon dioxide. The catalyst material may be copper oxide and/or manganese dioxide. The method of making the catalyst is described in British Patent No. 1,315,374. Finally, U.S. Pat. No. 5,258,340 describes a mixed transition metal oxide catalyst for the oxidation of carbon monoxide to carbon dioxide. This catalyst is said to be useful for incorporation into smoking articles.

Metal oxides, such as iron oxide have also been incorporated into cigarettes for various purposes. For example, in WO 87/06104, the addition of small quantities of zinc oxide or ferric oxide to tobacco is described, for the purposes of reducing or eliminating the production of certain byproducts, such as nitrogen-carbon compounds, as well as removing the stale "after taste" associated with cigarettes. The iron oxide is provided in particulate form, such that under combustion conditions, the ferric oxide or zinc oxide present in minute quantities in particulate form is reduced to iron. The iron is claimed to dissociate water vapor into hydrogen and oxygen, and cause the preferential combustion of nitrogen with hydrogen, rather than with oxygen and carbon, thereby preferentially forming ammonia rather than the nitrogen-carbon compounds.

In another example, U.S. Pat. No. 3,807,416 describes a smoking material comprising reconstituted tobacco and zinc oxide powder. Further, U.S. Pat. No. 3,720,214 relates to a smoking article composition comprising tobacco and a catalytic agent consisting essentially of finely divided zinc oxide. This composition is described as causing a decrease in the amount of polycyclic aromatic compounds during smoking. Another approach to reducing the concentration of carbon monoxide is described in WO 00/40104, which describes combining tobacco with loess and optionally iron oxide compounds as additives. The oxide compounds of the constituents in loess, as well as the iron oxide additives are said to reduce the concentration of carbon monoxide.

Moreover, iron oxide has also been proposed for incorporation into tobacco articles, for a variety of other purposes. For example, iron oxide has been described as particulate inorganic filler (e.g. U.S. Pat. Nos. 4,197,861; 4,195,645; and 3,931,824), as a coloring agent (e.g. U.S. Pat. No. 4,119,104) and in powder form as a burn regulator (e.g. U.S. Pat. No. 4,109,663). In addition, several patents describe treating filler materials with powdered iron oxide to improve taste, color and/or appearance (e.g. U.S. Pat. Nos. 6,095,152; 5,598,868; 5,129,408; 5,105,836 and 5,101,839). CN 1312038 describes a cigarette comprising iron and iron oxide (including FeO, $Fe_2O_3$, $Fe_3O_4$, and ferrite) as additives for reducing stimulant and abnormal smell of smoke and reducing certain components of smoke. However, the prior attempts to make cigarettes incorporating metal oxides, such as FeO or $Fe_2O_3$ have not led to the effective reduction of carbon monoxide in mainstream smoke.

Despite the developments to date, there is interest in improved and more efficient methods and compositions for lowering the amount of carbon monoxide and/or nitric oxide in the mainstream smoke of a cigarette during smoking. Preferably, such methods and compositions should not involve expensive or time consuming manufacturing and/or processing steps. More preferably, it should be possible to catalyze or oxidize carbon monoxide and/or nitric oxide not only in the filter region of the cigarette, but also along the entire length of the cigarette during smoking.

SUMMARY

The invention provides cut filler compositions, cigarettes, methods for making cigarettes and methods for smoking cigarettes which involve the use of partially reduced nanoparticle additives capable of acting as an oxidant for the conversion of carbon monoxide to carbon dioxide and/or as a catalyst for the conversion of nitric oxide to nitrogen.

In one embodiment, the invention relates to a cut filler composition comprising tobacco and at least one partially reduced additive capable of acting as a catalyst for the conversion of carbon monoxide to carbon dioxide and/or a catalyst for the conversion of nitric oxide to nitrogen. The partially reduced additive is in the form of nanoparticles.

In another embodiment, the invention relates to a cigarette comprising a tobacco rod comprising a cut filler composition having tobacco and at least one partially reduced additive capable of acting as a catalyst for the conversion of carbon monoxide to carbon dioxide and/or a catalyst for the conversion of nitric oxide to nitrogen. The partially reduced additive is in the form of nanoparticles. The cigarette will preferably have about 5 mg partially reduced additive per cigarette to about 100 mg partially reduced additive per cigarette, or the cigarette may more preferably have about 40 mg partially reduced additive per cigarette to about 50 mg partially reduced additive per cigarette.

In another embodiment, the invention relates to a method of making a cigarette, comprising:

(i) treating $Fe_2O_3$ nanoparticles with a reducing gas, so as to form at least one partially reduced additive capable of acting as a catalyst for the conversion of carbon monoxide to carbon dioxide and/or a catalyst for the conversion of nitric oxide to nitrogen, and wherein the partially reduced additive is in the form of nanoparticles;

(ii) adding the partially reduced additive to a cut filler composition;

(iii) providing the cut filler composition comprising the partially reduced additive to a cigarette making machine to form a tobacco rod; and (iv) placing a paper wrapper around the tobacco rod to form the cigarette.

In yet another embodiment of the invention, the invention relates to a method of smoking a cigarette comprising lighting the cigarette to form smoke and drawing the smoke through the cigarette, wherein the cigarette comprises a tobacco rod comprising a cut filler composition having tobacco and at least one partially reduced additive capable of acting as a catalyst for the conversion of carbon monoxide to carbon dioxide and/or a catalyst for the conversion of nitric oxide to nitrogen. The partially reduced additive is in the form of nanoparticles.

Preferably, the partially reduced additive used in the various embodiments of the invention is capable of acting as both a catalyst for the conversion of carbon monoxide to carbon dioxide and a catalyst for the conversion of nitric oxide to nitrogen. The partially reduced additive may be formed by partially reducing a compound selected from metal oxides, doped metal oxides and mixtures thereof. For example, the compound that is partially reduced may be selected from the group consisting of $Fe_2O_3$, CuO, $TiO_2$, $CeO_2$, $Ce_2O_3$, $Al_2O_3$, $Y_2O_3$ doped with zirconium, $Mn_2O_3$ doped with palladium, and mixtures thereof. Preferably, the partially reduced additive comprises $Fe_2O_3$ nanoparticles which have been treated with a reducing gas to form the partially reduced additive. In such case, the $Fe_2O_3$ may additionally be further reduced in situ during smoking of the cut filler or cigarette to form at least one reduced species selected from the group consisting of $Fe_3O_4$, FeO or Fe.

In an embodiment, the partially reduced nanoparticle additive is present in an amount effective to convert at least 50% of the carbon monoxide to carbon dioxide and/or at least 50% of the nitric oxide to nitrogen, or in an amount effective to convert at least 80% of the carbon monoxide to carbon dioxide and/or at least 80% of the nitric oxide to nitrogen.

The partially reduced nanoparticle additive has an average particle size preferably less than about 500 nm, more preferably less than about 100 nm, even more preferably less than about 50 nm, and most preferably less than about 5 n. Preferably, the partially reduced nanoparticle additive has a surface area from about 20 $m^2/g$ to about 400 $m^2/g$, or more preferably from about 200 $m^2/g$ to about 300 $m^2/g$.

DETAILED DESCRIPTION

Figure 1:
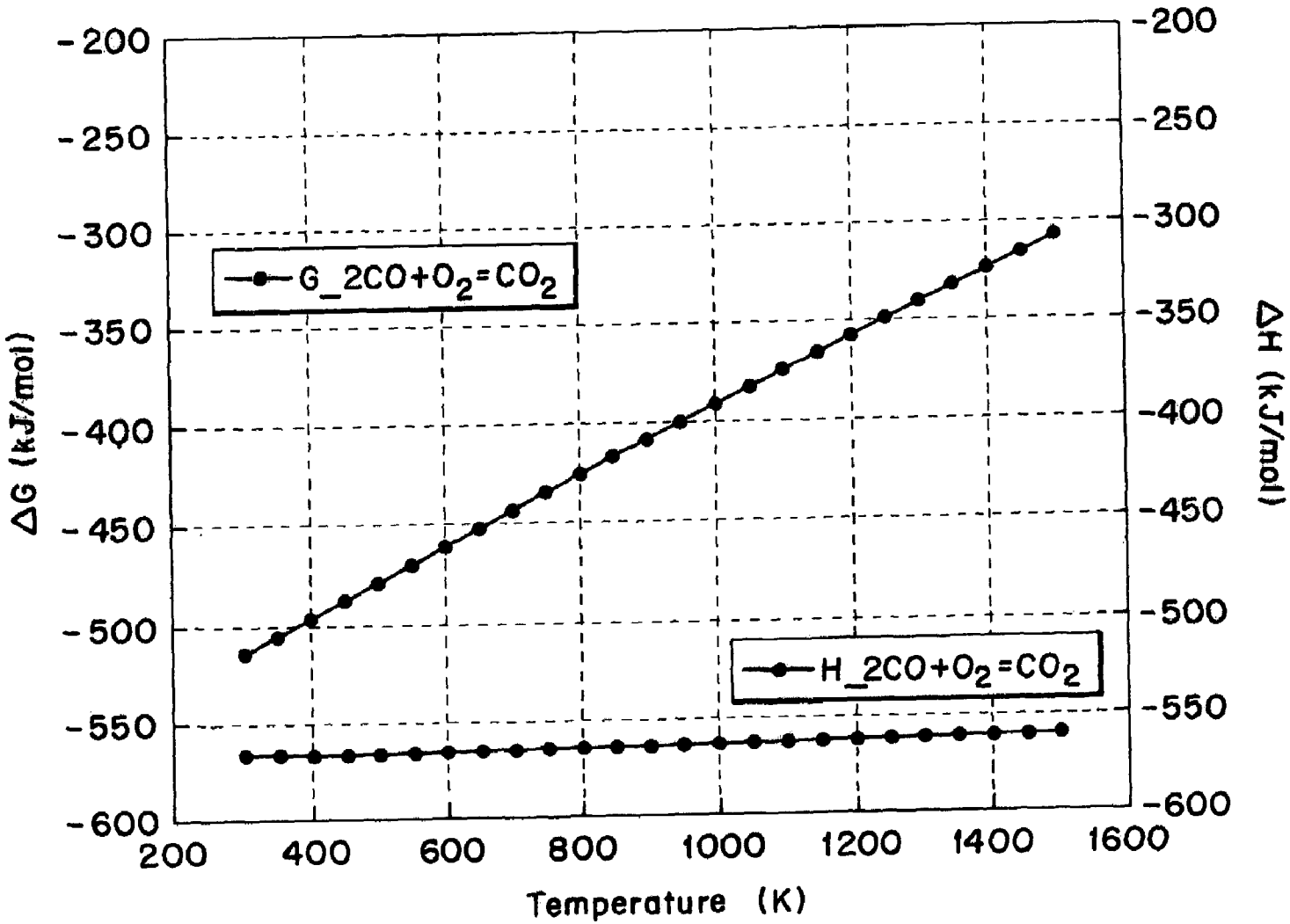
FIG. 1 depicts the temperature dependence of the Gibbs Free Energy and Enthalpy for the oxidation reaction of carbon monoxide to carbon dioxide.

Through the invention, the amount of carbon monoxide and/or nitric oxide in mainstream smoke can be reduced, thereby also reducing the amount of carbon monoxide and/or nitric oxide reaching the smoker or given off as second-hand smoke. In particular, the invention provides cut filler compositions, cigarettes, methods for making cigarettes and methods for smoking cigarettes, which involve the use of partially reduced nanoparticle additives, which are partially reduced to form a catalyst for the conversion of carbon monoxide to carbon dioxide and/or a catalyst for the conversion of nitric oxide to nitrogen. Preferably, the partially reduced nanoparticle additives catalyze the following reaction:

$$2CO+2NO \leftrightarrows 2CO_2+N_2$$

Preferably, the partially reduced additive comprises $Fe_2O_3$ nanoparticles which have been treated with a reducing gas to form the partially reduced additive, which typically comprises a mixture of $Fe_3O_4$, FeO and/or Fe, along with any unreduced $Fe_2O_3$. In such case, the $Fe_2O_3$ may additionally be further reduced in situ during the smoking of the cut filler or cigarette to form at least one reduced species selected from the group consisting of $Fe_3O_4$, FeO or Fe.

The term "mainstream" smoke refers to the mixture of gases passing down the tobacco rod and issuing through the filter end, i.e. the amount of smoke issuing or drawn from the mouth end of a cigarette during smoking of the cigarette. The mainstream smoke contains smoke that is drawn in through both the lighted region, as well as through the cigarette paper wrapper.

The total amount of carbon monoxide formed during smoking comes from a combination of three main sources: thermal decomposition (about 30%), combustion (about 36%) and reduction of carbon dioxide with carbonized tobacco (at least 23%). Formation of carbon monoxide from thermal decomposition starts at a temperature of about 180° C., and finishes at around 1050° C., and is largely controlled by chemical kinetics. Formation of carbon monoxide and carbon dioxide during combustion is controlled largely by the diffusion of oxygen to the surface ($k_a$) and the surface reaction ($k_b$). At 250° C., $k_a$ and $k_b$, are about the same. At 400° C., the reaction becomes diffusion controlled. Finally, the reduction of carbon dioxide with carbonized tobacco or charcoal occurs at temperatures around 390° C. and above.

Nitric oxide, though produced in lesser quantities than the carbon monoxide, also is generated by similar thermal decomposition, combustion and reduction reactions.

Besides the tobacco constituents, the temperature and the oxygen concentration are the two most significant factors affecting the formation and reaction of carbon monoxide and carbon dioxide. While not wishing to be bound by theory, it is believed that the partially reduced nanoparticle additives can target the various reactions that occur in different regions of the cigarette during smoking. During smoking there are three distinct regions in a cigarette: the combustion zone, the pyrolysis/distillation zone, and the condensation/filtration zone. First, the "combustion region" is the burning zone of the cigarette produced during smoking of the cigarette, usually at the lighted end of a cigarette. The temperature in the combustion zone ranges from about 700° C. to about 950° C., and the heating rate can go as high as 500° C./second. The concentration of oxygen is low in this region, since it is being consumed in the combustion of tobacco to produce carbon monoxide, carbon dioxide, water vapor, and various organics. This reaction is highly exothermic and the heat generated here is carried by gas to the pyrolysis/distillation zone. The low oxygen concentrations coupled with the high temperature leads to the reduction of carbon dioxide to carbon monoxide by the carbonized tobacco. In this region, the partially reduced nanoparticle additive acts as an oxidant to convert carbon monoxide to carbon dioxide. As an oxidant, the partially reduced nanoparticle additive oxidizes carbon monoxide in the absence of oxygen. The oxidation reaction begins at around 150° C., and reaches maximum activity at temperatures higher than about 460° C.

The "pyrolysis region" is the region behind the combustion region, where the temperatures range from about 200° C. to about 600° C. This is where most of the carbon monoxide is produced. The major reaction in this region is the pyrolysis (i.e. the thermal degradation) of the tobacco that produces carbon monoxide, carbon dioxide, smoke components, and charcoal using the heat generated in the combustion zone. There is some oxygen present in this zone, and thus the partially reduced nanoparticle additive may act as a catalyst for the oxidation of carbon monoxide to carbon dioxide. As a catalyst, the partially reduced nanoparticle additive catalyzes the oxidation of carbon monoxide by oxygen to produce carbon dioxide. The catalytic reaction begins at 150° C. and reaches maximum activity around 300° C. The partially reduced nanoparticle additive preferably retains its oxidant capability after it has been used as a catalyst, so that it can also function as an oxidant in the combustion region as well.

Third, there is the condensation/filtration zone, where the temperature ranges from ambient to about 150° C. The major process is the condensation/filtration of the smoke components. Some amount of carbon monoxide, carbon dioxide, nitric oxide and/or nitrogen diffuse out of the cigarette and some oxygen diffuses into the cigarette. However, in general, the oxygen level does not recover to the atmospheric level.

As mentioned above, the partially reduced nanoparticle additives may function as a catalyst for the conversion of carbon monoxide to carbon dioxide and/or a catalyst for the conversion of nitric oxide to nitrogen. In a preferred embodiment of the invention, the partially reduced nanoparticle additive is capable of acting as both a catalyst for the conversion of carbon monoxide to carbon dioxide and a catalyst for the conversion of nitric oxide to nitrogen.

By "nanoparticles" is meant that the particles have an average particle size of less than a micron. The partially reduced nanoparticle additive preferably has an average particle size less than about 500 nm, more preferably less than about 100 nm, even more preferably less than about 50 nm, and most preferably less than about 5 nm. Preferably, the partially reduced nanoparticle additive has a surface area from about 20 $m^2/g$ to about 400 $m^2/g$, or more preferably from about 200 $m^2/g$ to about 300 $m^2/g$.

The nanoparticles used to make the partially reduced nanoparticle additive may be made using any suitable technique, or purchased from a commercial supplier. Preferably, the selection of an appropriate partially reduced additive will take into account such factors as stability and preservation of activity during storage conditions, low cost and abundance of supply. Preferably, the partially reduced additive will be a benign material. For instance, MACH I, Inc., King of Prussia, Pa. sells $Fe_2O_3$ nanoparticles under the trade names NANOCAT® Superfine Iron Oxide (SFIO) and NANOCAT® Magnetic Iron Oxide. The NANOCAT® Superfine Iron Oxide (SFIO) is amorphous ferric oxide in the form of a free flowing powder, with a particle size of about 3 nm, a specific surface area of about 250 $m^2/g$, and a bulk density of about 0.05 g/mL. The NANOCAT® Superfine Iron Oxide (SFIO) is synthesized by a vapor-phase process, which renders it free of impurities that may be present in conventional catalysts, and is suitable for use in food, drugs, and cosmetics. The NANOCAT® Magnetic Iron Oxide is a free flowing powder with a particle size of about 25 nm and a surface area of about 40 $m^2/g$.

The partially reduced nanoparticle additive is preferably produced by subjecting a compound to a reducing environment, to form one or more compounds that are capable of acting as a catalyst for the conversion of carbon monoxide to carbon dioxide and/or a catalyst for the conversion of nitric oxide to nitrogen. For example, the starting compounds may be subjected to a reducing gas such as CO, $H_2$ or $CH_4$, under time, temperature and/or pressure conditions sufficient to form a partially reduced mixture. For example, $Fe_2O_3$ nanoparticles may be partially reduced to form the partially reduced nanoparticle additive, which typically comprises a mixture of $Fe_3O_4$, FeO and/or Fe, along with any unreduced $Fe_2O_3$. The $Fe_2O_3$ partially reduced nanoparticles can be treated in a suitable reducing environment, i.e. a reducing gas or a reducing reagent, to obtain the partially reduced nanoparticle additive. The partially reduced nanoparticle additive may also be further reduced in situ during smoking of the cut filler or cigarette, particularly upon reaction of carbon monoxide or nitric oxide that is formed during the smoking of the cigarette.

Amorphous phases, synergism, and size effects in nano scale, are three factors that could improve the performance of the carbon monoxide or nitric oxide catalyst. Some nanoparticles also possess an amorphous structure. Experiments on the structure of NANOCAT® Superfine $Fe_2O_3$ using a quartz flow tube reactor (length: 50 cm, I.D: 0.9 cm) attached to a digital flow meter and a multi-gas analyzer. A schematic diagram of the experimental set up is show in FIG. 16. A piece of quartz wool dusted with known amount of $Fe_2O_3$ was placed in the middle of the flow tube, sandwiched by the other two clean pieces of quartz wool. The quartz flow tube was then placed inside a Thermcraft furnace controlled by a temperature programmer. The sample temperature was a monitored by an Omega K-type thermocouple inserted into the dusted quartz wool. Another thermocouple was placed in the middle of the furnace, outside of the flow tube, to monitor and record the furnace temperature. The temperature data were recorded by a Labview based program. The inlet gases were controlled by a Hastings digital flow meter. The gases were mixed before entering the flow tube. The effluent gas was analyzed either by an NLT2000 multi-gas analyzer (non-disperse near infrated detector for CO and $CO_2$, paramagnetic detector for $O_2$), or a Blazer Thermal Star quadrupole mass spectrometer thorugh a sampling capillary. When the mass spectrometer was used as the monitor, a 15% contribution from the fragmentation of $CO_2$ (m/e=44) to CO (m/e=28) had been accounted for.

The NANOCAT® Superfine $Fe_2O_3$ (having particle size of 3 nm) was purchased from Mach I Inc. The sample was used without further treatment. The CO (3.95%), and $O_2$ (21.0%) gases, all balanced with Helium, were purchased from BOC Gases with certified analysis. For HRTEM (High Resolution Transmission Electron Microscopy), the sample was lightly crushed and suspended in methanol. The resulting suspension was applied to lacey carbon grids and allowed to evaporate. The sample was examined with a Philips-FEI Technai filed emission transmission electron microscope operating to 200 KV. Images were recorded digitally with a Gatan slow scan camera (GIF). EDS spectra were collected with a thin window EDAX spectrometer.

NANOCAT® Superfine $Fe_2O_3$ is a brown colored, free flow powder with a bulk density of only 0.05 $g/cm^3$. Powder X-Ray diffraction patterns of NANOCAT® Superfine $Fe_2O_3$ revealed only broad, indistinct reflections, suggesting that the material was either amorphous or of a particle size too small for this method to resolve. HRTEM, on the other hand, is capable of resolving atomic lattices regardless of particle size, and was employed here to image the lattices directly. The HRTM analyses indicated that NANOCAT® Superfine $Fe_2O_3$ consisted of at least two separate phases of different grain sizes. One population of grains, constituting the majority of the particles, possessed diameter of 3 to 5 nm. The other size fraction consisted of particles that were much larger with diameters of up to 24 nm. HTEM images of NANOCAT® $Fe_2O_3$ nanoparticles show both crystalline and amorphous domains. The high-resolution lattice images of the larger-grained population showed them to be well crystalline with the structure of maghemite ($Fe_2O_3$). The HRTM image of smaller particles suggested a mix of glassy (amorphous) structure and crystalline particles. These crystalline phases were possibly the trivalent iron phases FeOOH and/or $Fe(OH)_3$. The amorphous component of NANOCAT® $Fe_2O_3$ could also contribute to its high catalytic activity.

Among nano-sized materials, transitional metal oxides, such as iron oxide, having dual functions as a CO or NO catalyst in the presence of $O_2$ and as a CO oxidant for the direct oxidation of CO in the absence of $O_2$ are especially preferred. A catalyst which can also be used as an oxidant is especially useful for certain application, such as within a burning cigarette, where $O_2$ is minimal and the reusability of the catalyst is not required. For instance, NANOCAT® Superfine $Fe_2O_3$, manufactured by Mach I, Inc., is a catalyst and oxidant of CO oxidation.

Figure 2:
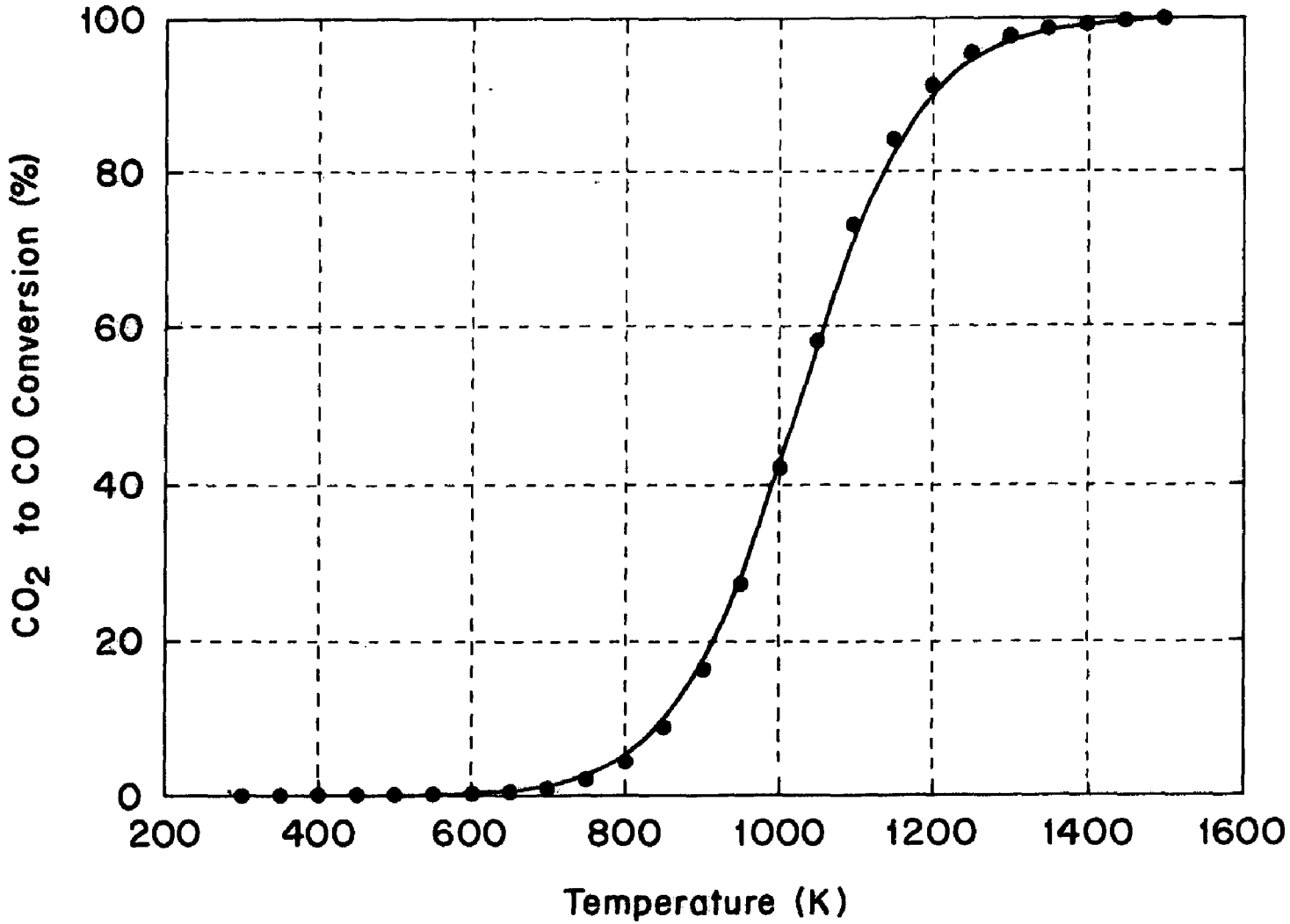
FIG. 2 depicts the temperature dependence of the percentage conversion of carbon dioxide to carbon monoxide by carbon to form carbon monoxide.

In selecting a partially reduced nanoparticle additive, various thermodynamic considerations may be taken into account, to ensure that oxidation and/or catalysis will occur efficiently, as will be apparent to the skilled artisan. For example, FIG. 1 shows a thermodynamic analysis of the Gibbs Free Energy and Enthalpy temperature dependence for the oxidation of carbon monoxide to carbon dioxide. FIG. 2 shows the temperature dependence of the percentage of carbon dioxide conversion with carbon to form carbon monoxide.

In a preferred embodiment, at least partially reduced metal oxide nanoparticles are used. Any suitable metal oxide in the form of nanoparticles may be used. Optionally, one or more metal oxides may also be used as mixtures or in combination, where the metal oxides may be different chemical entities or different forms of the same metal oxide.

Preferred at least partially reduced nanoparticle additives include metal oxides, such as $Fe_2O_3$, CuO, $TiO_2$, $CeO_2$, $Ce_2O_3$, or $Al_2O_3$, or doped metal oxides such as $Y_2O_3$ doped with zirconium, $Mn_2O_3$ doped with palladium. Mixtures of partially reduced nanoparticle additives may also be used. In particular, at least partially reduced $Fe_2O_3$ is preferred because it can be reduced to FeO or Fe after the reaction. Further, when at least partially reduced $Fe_2O_3$ is used as the partially reduced nanoparticle additive, it will not be converted to an environmentally hazardous material. Moreover, use of a precious metal can be avoided, as the reduced $Fe_2O_3$ nanoparticles are economical and readily available. In particular, partially reduced forms of NANOCAT® Superfine Iron Oxide (SFIO) and NANOCAT® Magnetic Iron Oxide, described above, are preferred partially reduced nanoparticle additives.

Figure 3:
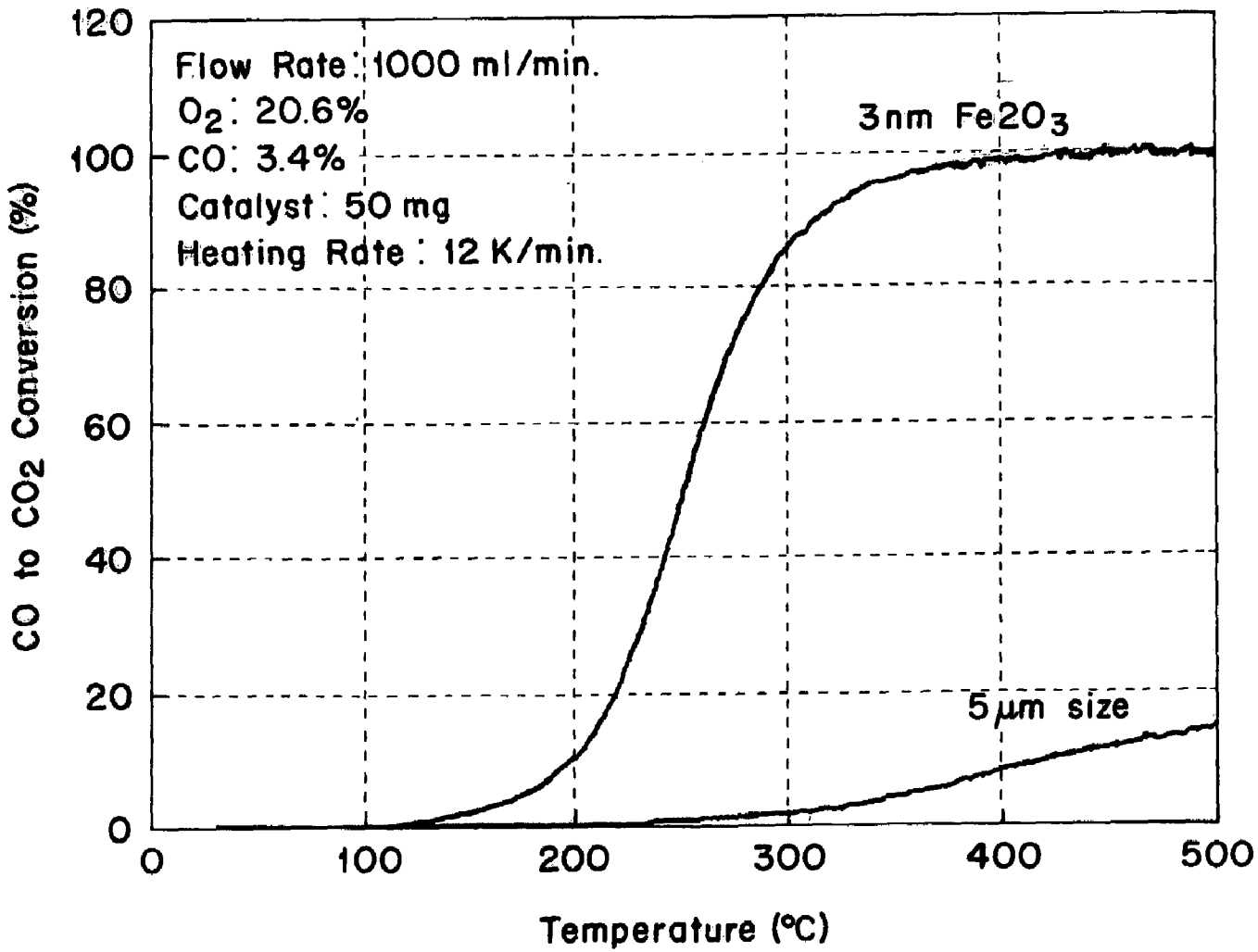
FIG. 3 depicts a comparison between the catalytic activity of $Fe_2O_3$ nanoparticles (NANOCAT® Superfine Iron Oxide (SFIO) from MACH I, Inc., King of Prussia, Pa.) having an average particle size of about 3 run, versus $Fe_2O_3$ powder (from Aldrich Chemical Company) having an average particle size of about 5 μm.

NANOCAT® Superfine $Fe_2O_3$ can be used as catalyst or as an oxidant for CO oxidation, depending on the availability of the $O_2$. FIG. 3 shows a comparison between the catalytic activity of $Fe_2O_3$ nanoparticles (NANOCAT® Superfine Iron Oxide (SFIO) from MACH I, Inc., King of Prussia, Pa.) having an average particle size of about 3 nm, versus $Fe_2O_3$ powder (from Aldrich Chemical Company) having an average particle size of about 5 μm. The $Fe_2O_3$ nanoparticles show a much higher percentage of conversion of carbon monoxide to carbon dioxide than the $Fe_2O_3$ having an average particle size of about 5 μm. As shown in FIG. 3, 50 mg of the NANOCAT® $Fe_2O_3$ can catalyze more than 98% CO to $CO_2$ at 400° C. in an inlet gas mixture of 3.4% CO and 20.6% 02 at 1000 ml/minute. Under identical conditions, the same amount of the α-$Fe_2O_3$ powder with a particle size of 5 μm, can only catalyze about 10% CO to $CO_2$. In addition to that, the initial light off temperature for NANOCAT® $Fe_2O_3$ is more than 100° C. lower than that of α-$Fe_2O_3$ powder. The reason for the dramatic improvement of the nanoparticles over the non-nanoparticles it two fold. First, the BET surface area of the nanoparticle is much higher (250 $m^2/g$ vs. 3.2 $m^2/g$). Secondly, there are more coordination unsaturated sites on the nanoparticles surface. These are the catalytically active sites. Hence, even without changing the chemical composition, the performance of the catalyst can be increased by reducing the size of the catalyst to nano-scale.

Figure 4A:
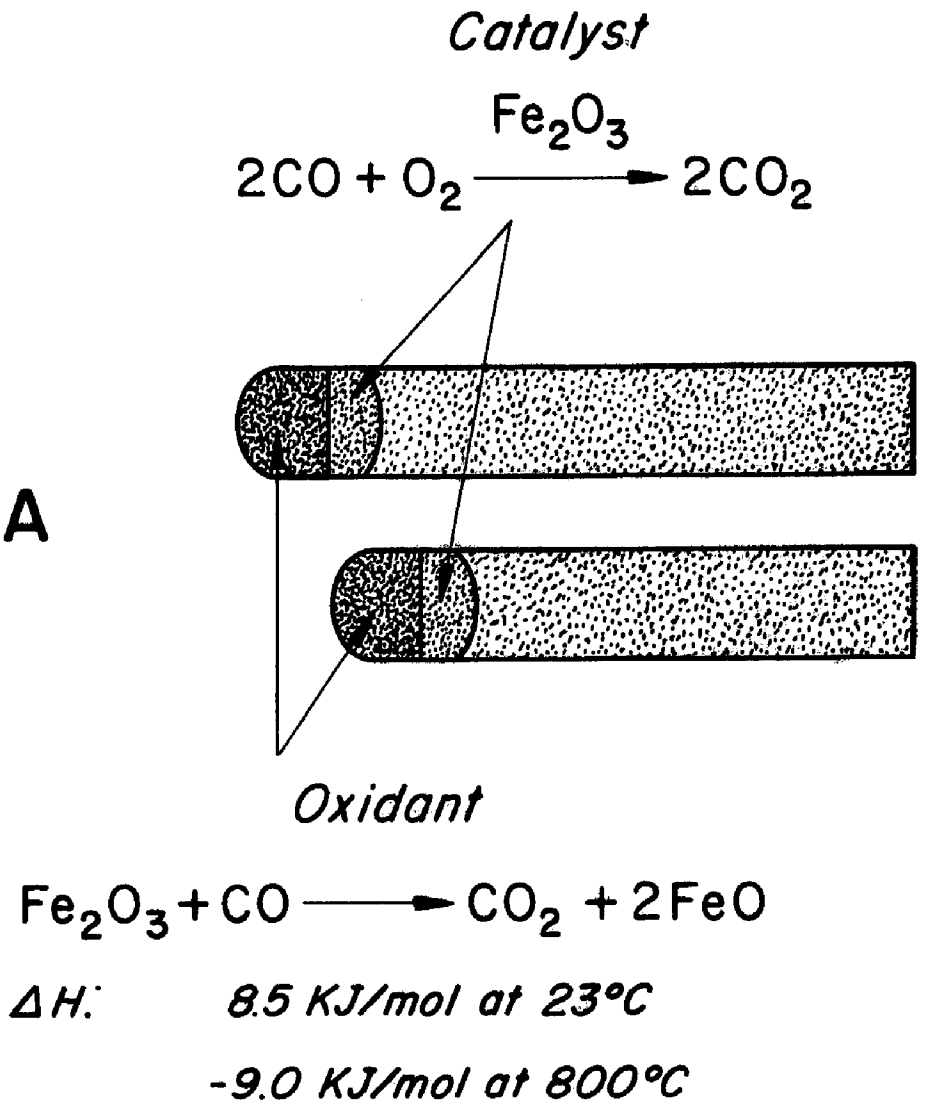
FIGS. 4A and 4B depict the pyrolysis region (where the $Fe_2O_3$ nanoparticles act as a catalyst) and the combustion zone (where the $Fe_2O_3$ nanoparticles act as an oxidant) in a cigarette.
Figure 4B:
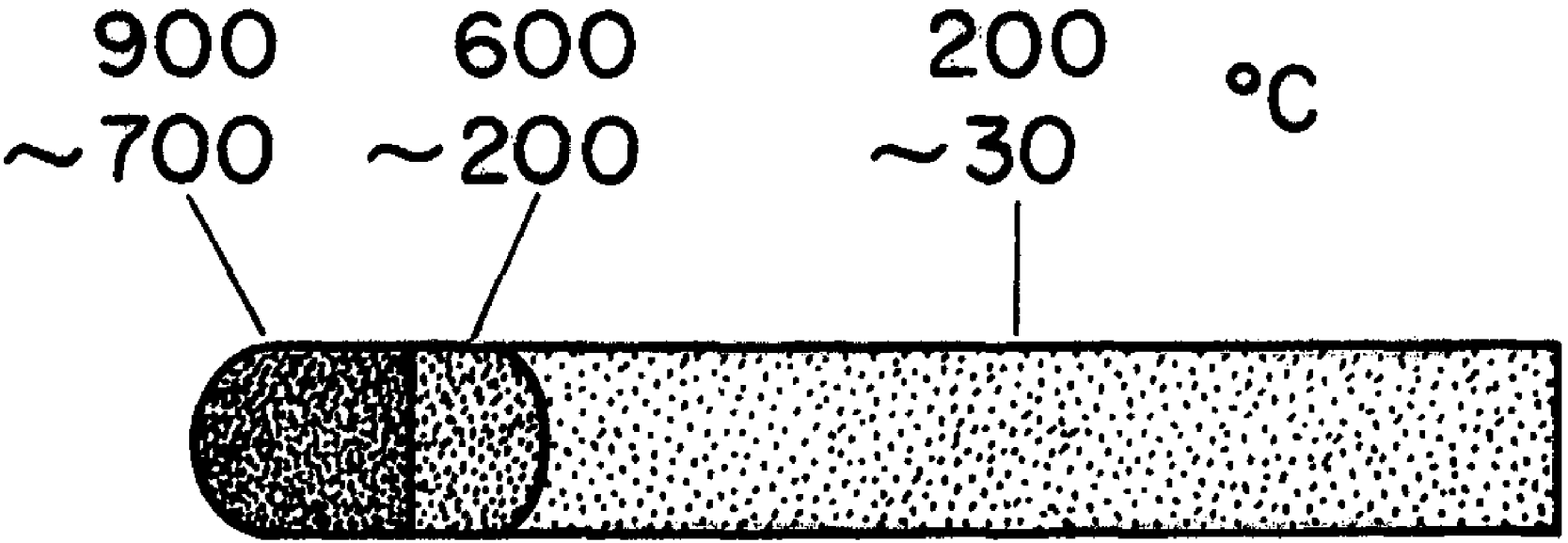

Partially reduced $Fe_2O_3$ nanoparticles are capable of acting as both an oxidant and catalyst for the conversion of carbon monoxide to carbon dioxide and for the conversion of nitric oxide to nitrogen. As shown schematically in FIG. 4A, the $Fe_2O_3$ nanoparticles act as a catalyst in the pyrolysis zone, and act as an oxidant in the combustion region. FIG. 4B shows various temperature zones in a lit cigarette. The oxidant/catalyst dual function and the reaction temperature range make partially reduced $Fe_2O_3$ nanoparticles useful for the reduction of carbon monoxide and/or nitric oxide during smoking. Also, during the smoking of the cigarette, the $Fe_2O_3$ nanoparticles may be used initially as a catalyst (i.e. in the pyrolysis zone), and then as an oxidant (i.e. in the combustion region).

Various experiments to further study thermodynamic and kinetics of various catalysts were conducted using a quartz flow tube reactor. The kinetics equation governing these reactions is as follows:

$$ln(1-x)=-A_o e^{-(Ea/RT)}\cdot(s\cdot 1/F)$$

where the variables are defined as follows:

x=the percentage of carbon monoxide converted to carbon dioxide $A_o$=the pre-exponential factor, $5\times10^{-6}$ $s^{-1}$ R=the gas constant, $1.987\times10^{-3}$ kcal/(mol·K)

Figure 5:
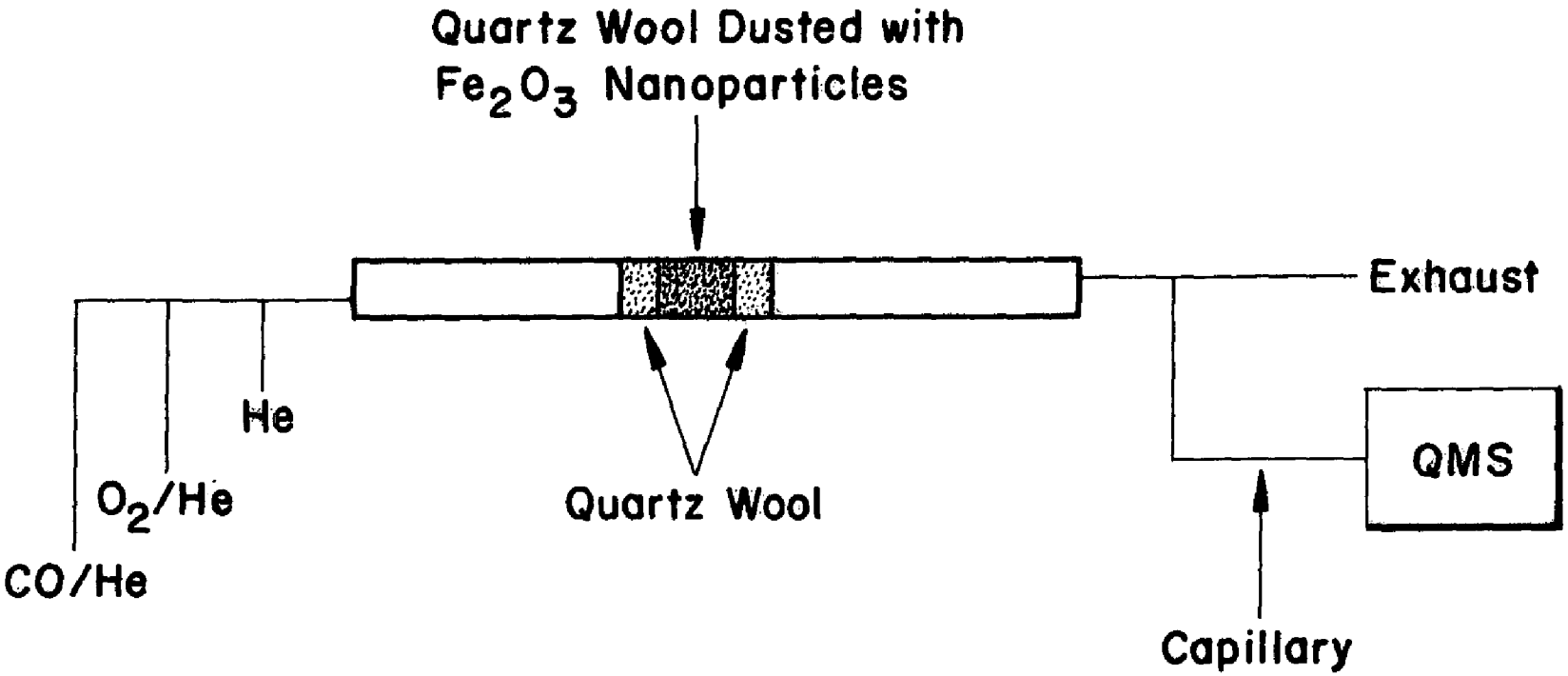
FIG. 5 depicts a schematic of a quartz flow tube reactor.

$E_a$=activation energy, 14.5 kcal/mol s=cross section of the flow tube, 0.622 $cm^2$ l=length of the catalyst, 1.5 cm F=flow rate, in $cm^3/s$ A schematic of a quartz flow tube reactor, suitable for carrying out such studies, is shown in FIG. 5. Helium, oxygen/helium and/or carbon monoxide/helium mixtures may be introduced at one end of the reactor. A quartz wool dusted with $Fe_2O_3$ nanoparticles is placed within the reactor. The products exit the reactor at a second end, which comprises an exhaust and a capillary line to a Quadrupole Mass Spectrometer ("QMS"). The relative amounts of products can thus be determined for a variety of reaction conditions.

Figure 6:
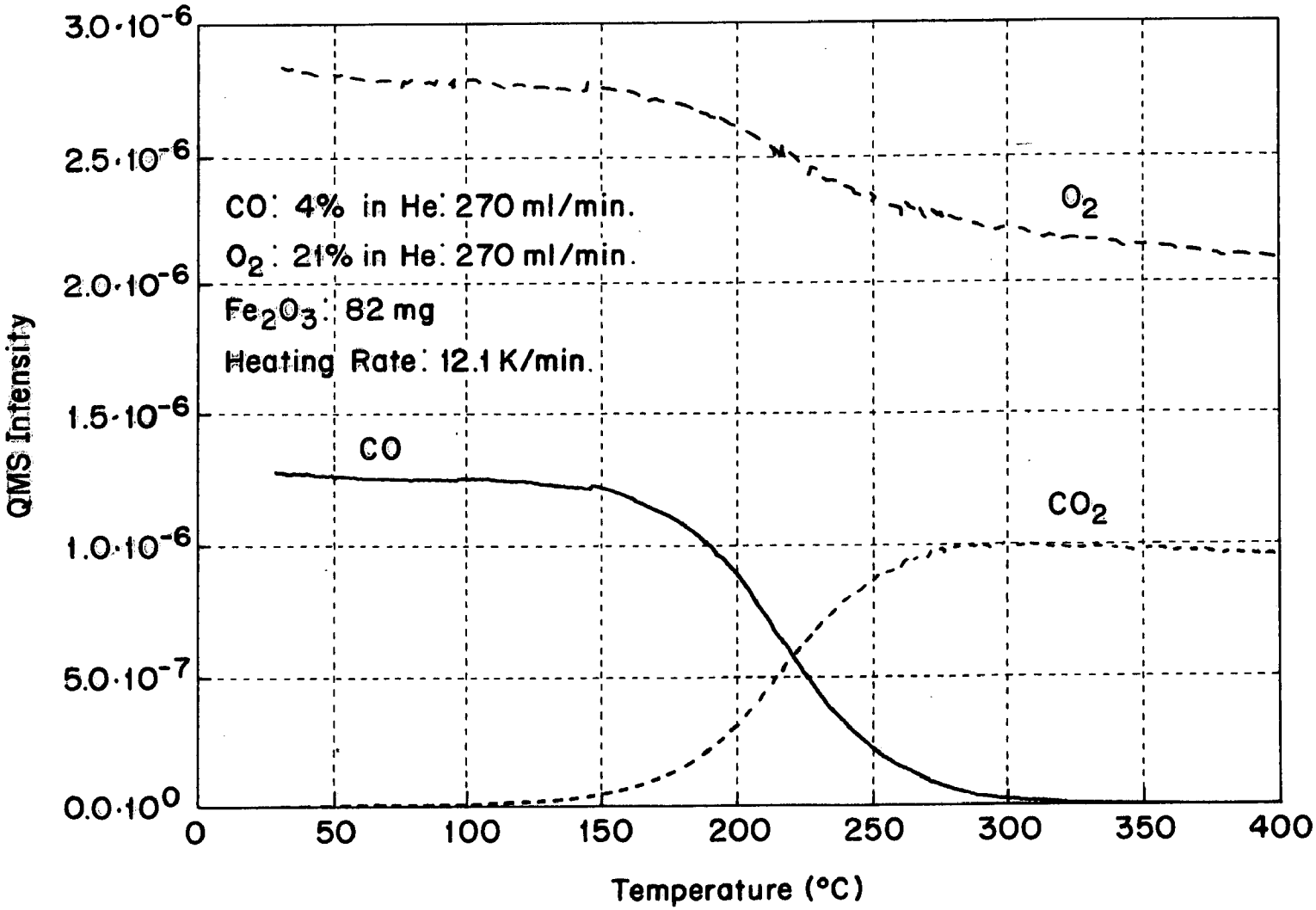
FIG. 6 illustrates the temperature dependence on the production of carbon monoxide, carbon dioxide and oxygen, when using $Fe_2O_3$ nanoparticles as the catalyst for the oxidation of carbon monoxide with oxygen to produce carbon dioxide.

FIG. 6 is a graph of temperature versus QMS intensity for a test wherein $Fe_2O_3$ nanoparticles are used as a catalyst for the reaction of carbon monoxide with oxygen to produce carbon dioxide. In the test, about 82 mg of $Fe_2O_3$ nanoparticles are loaded in the quartz flow tube reactor. Carbon monoxide is provided at 4% concentration in helium at a flow rate of about 270 mL/min, and oxygen is provided at 21% concentration in helium at a flow rate of about 270 mL/min. The heating rate is about 12.1 K/min. As shown in this graph, $Fe_2O_3$ nanoparticles are effective at converting carbon monoxide to carbon dioxide at temperatures above around 225° C.

Figure 7:
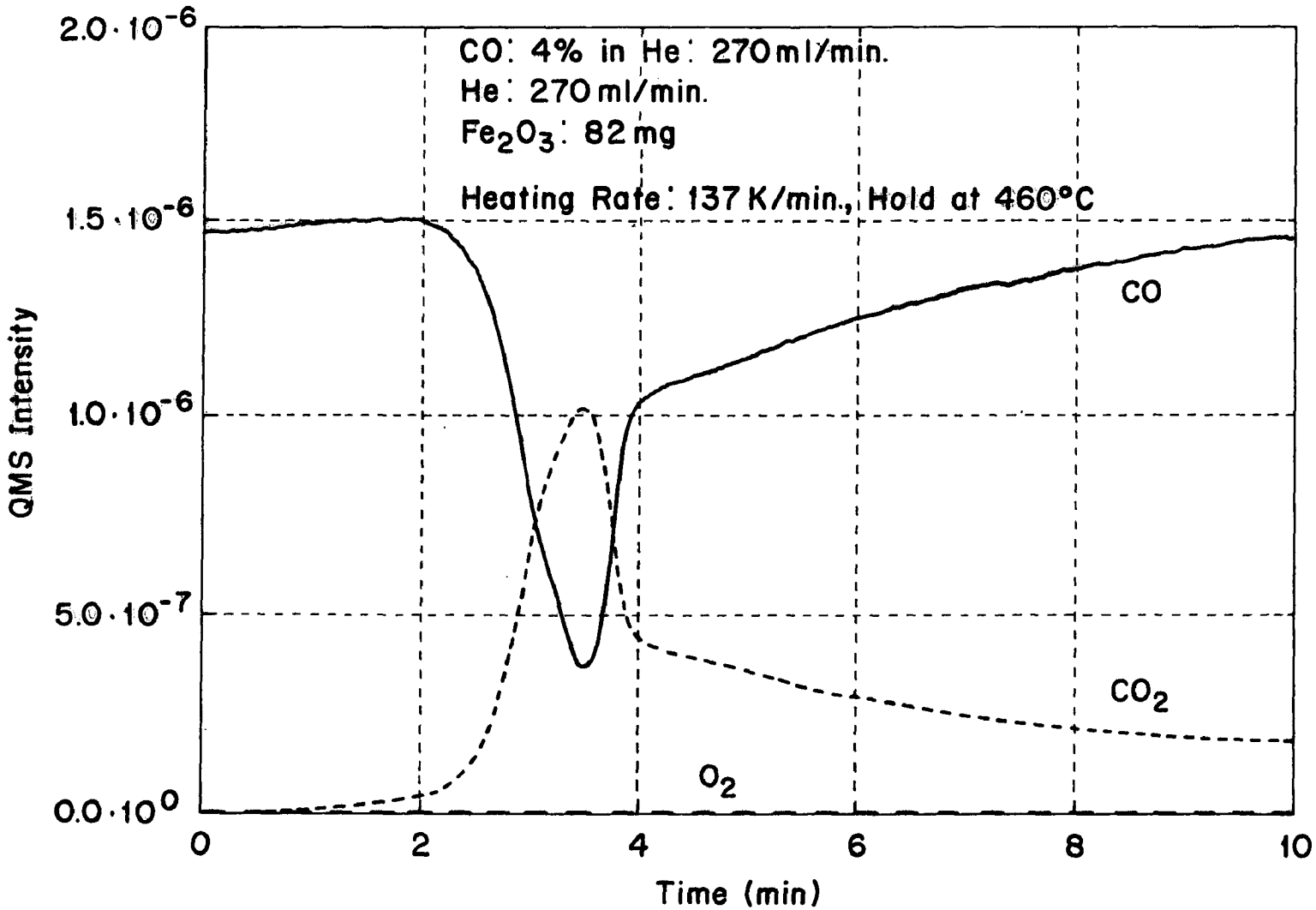
FIG. 7 illustrates the relative production of carbon monoxide, carbon dioxide and oxygen, when using $Fe_2O_3$ nanoparticles as an oxidant for the reaction of $Fe_2O_3$ with carbon monoxide to produce carbon dioxide and FeO.

FIG. 7 is a graph of time versus QMS intensity for a test wherein $Fe_2O_3$ nanoparticles are studied as an oxidant for the reaction of $Fe_2O_3$ with carbon monoxide to produce carbon dioxide and FeO. In the test, about 82 mg of $Fe_2O_3$ nanoparticles are loaded in the quartz flow tube reactor.

Carbon monoxide is provided at 4% concentration in helium at a flow rate of about 270 mL/min, and the heating rate is about 137 K/min to a maximum temperature of 460° C. As suggested by data shown in FIGS. 6 and 7, $Fe_2O_3$ nanoparticles are effective in conversion of carbon monoxide to carbon dioxide under conditions similar to those during smoking of a cigarette.

Figure 8A:
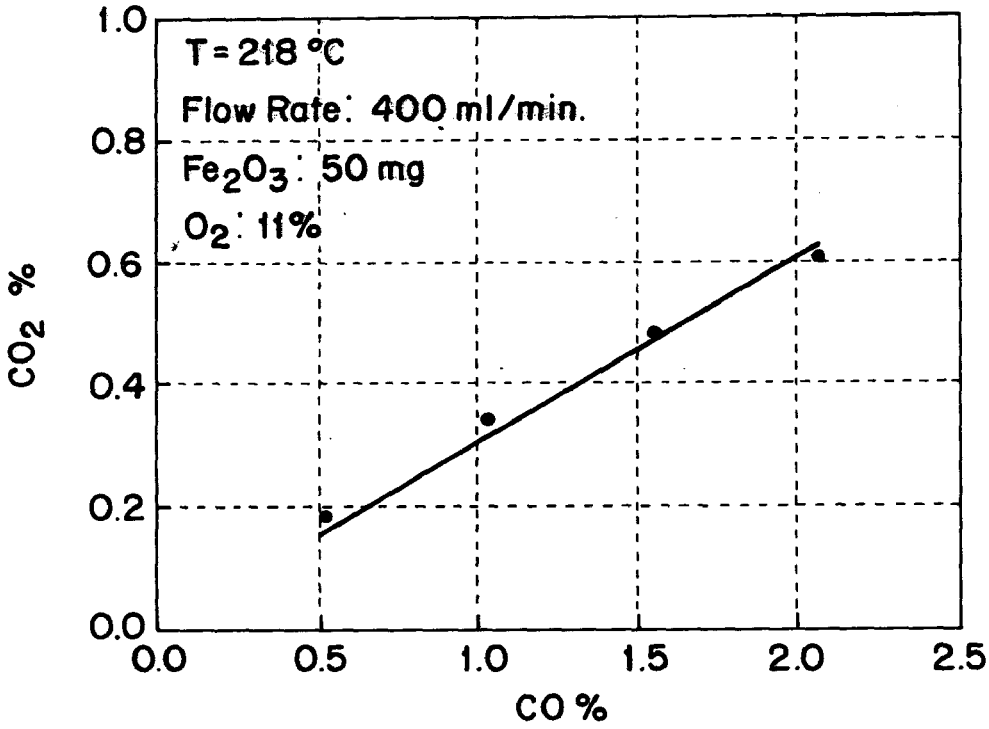
FIGS. 8A and 8B illustrate the reaction orders of carbon monoxide and carbon dioxide with $Fe_2O_3$ as a catalyst.
Figure 8B:
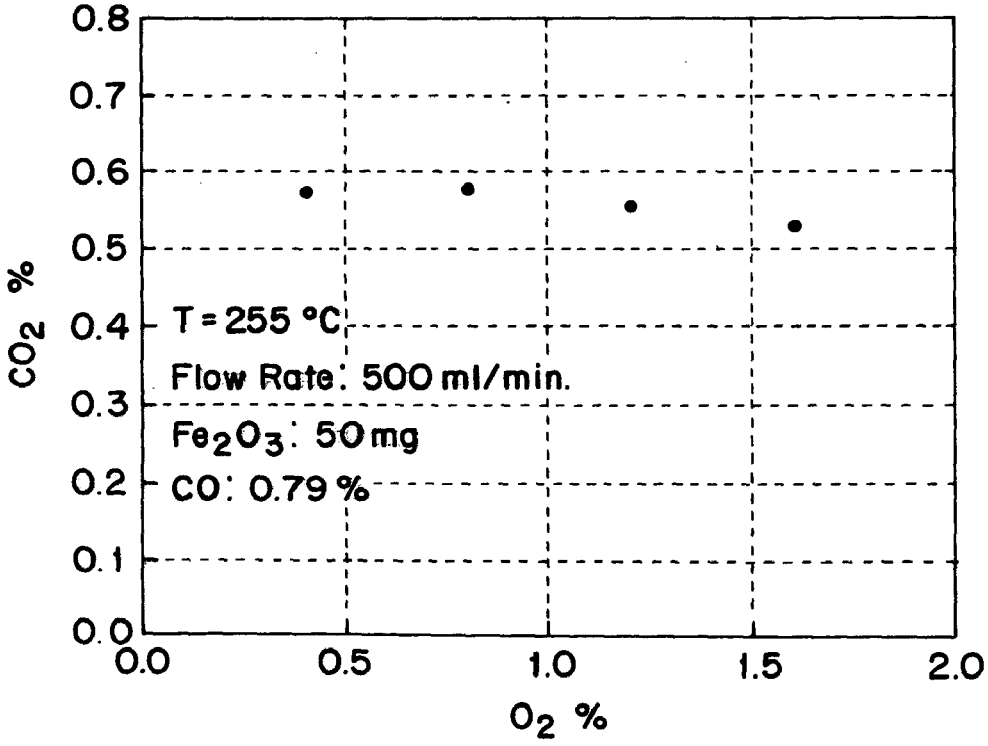

FIGS. 8A and 8B are graphs showing the reaction orders of carbon monoxide and carbon dioxide with $Fe_2O_3$ as a catalyst. The reaction order of CO was measured isothermally at 244° C. At this temperature, the CO to $CO_2$ conversion rate is about 50%. With a total flow rate of 400 ml/minute, the inlet 02 was kept constant at 11% while the inlet CO concentration was varied from 0.5 to 2.0%. The corresponding $CO_2$ concentration in the outlet was recorded and the data is shown in FIG. 8A. The linear relationship between the effluent $CO_2$ concentration and the inlet CO concentration indicated that the catalytic oxidation of CO on NANOCAT® is first order to CO.

The reaction order of $O_2$ was measured in a similar fashion. Care was taken to make sure that $O_2$ concentration was not lower than ½ of the CO inlet concentration, as the stoichiometry of the reaction required. The purpose was to prevent any direct oxidation of the CO by NANOCAT® because of insufficient $O_2$As shown in FIG. 8B, the increase of the $O_2$ concentration had very little effect on the $CO_2$ production in the effluent gas. Therefore, it can be concluded that the reaction order of $O_2$ is approximately zero Since the reaction is first order for CO and zero order for $O_2$, the overall reaction is a first order reaction. In the plug-flow tubular reactor, the reaction rate constant, k ($s^{-1}$), can be expressed as:

$$k=(u/v)ln(C_0/C)$$

where μis the flow rate in ml/s, V is the total volume of the catalyst in $cm^3$. $C_0$ is the volume percentage of CO in the gas inlet, C is the volume percentage of CO in the gas outlet. According to Arrhenius equation:

$$k=Ae^{(Ea/RT)}$$

where A is the pre-exponential factor in $s^{-1}$, $E_a$ is the apparent activation energy in kJ/mol, R is the gas constant and T is the absolute temperature in ° K. Combining these equations:

$$ln[-ln(1-x)]=lnA+ln(v/u)-E_a/RT$$

where x is the CO to $CO_2$ conversion rate, $$x=(C_o-C)/C_o$$

Figure 9:
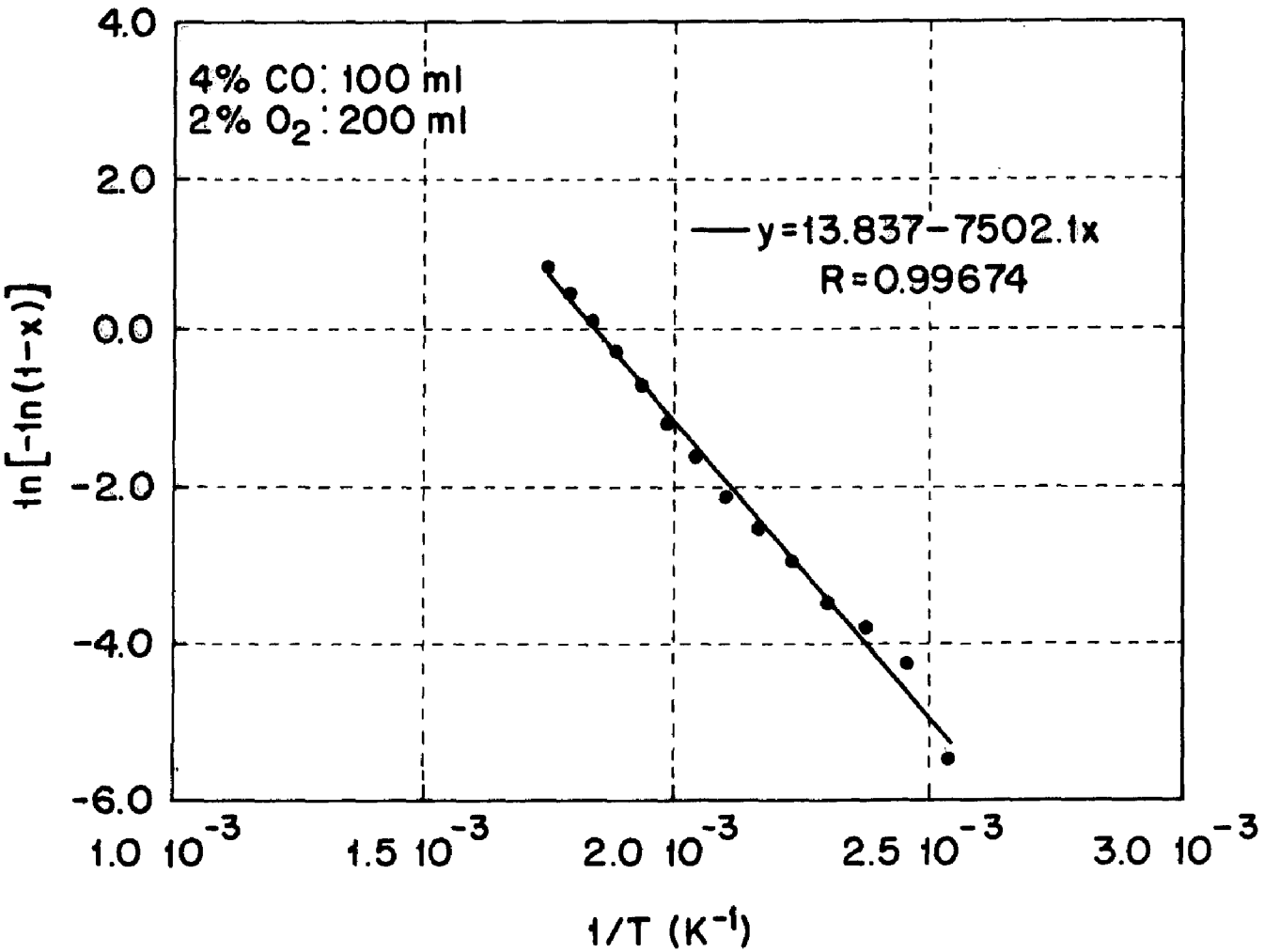
FIG. 9 depicts the measurement of the activation energy and the pre-exponential factor for the reaction of carbon monoxide with oxygen to produce carbon dioxide, using $Fe_2O_3$ nanoparticles as a catalyst for the reaction.

By plotting ln[−ln(1−$x$)] vs. 1/T, the apparent activation energy $E_a$ can be read from the slope and the pre-exponential factor A can be calculated from the intercept for the reaction of carbon monoxide with oxygen to produce carbon dioxide, using $Fe_2O_3$ nanoparticles as a catalyst for the reaction, as shown in FIG. 9.

The measured values of A and $E_a$ are tabulated in Table 1, along with values reported in the literature. The average $E_a$ of 14.5 kcal/mol is larger than the typical activation energy of the supported precious metal catalyst (<10 Kcal/mol). However, it is smaller than those of non nanoparticle $Fe_2O_3$ (≈20 Kcal/mol).

TABLE 1

Summary of the Activation Energies and Pre-exponential Factors

| | Flow Rate (mL/min) | CO % | $O_2$ % | $A_o$ ($s^{-1}$) | $E_a$ (kcal/mol) |
|---|---|---|---|---|---|
| 1 | 300 | 1.32 | 1.34 | $9.0 \times 10^7$ | 14.9 |
| 2 | 900 | 1.32 | 1.34 | $12.3 \times 10^6$ | 14.7 |
| 3 | 1000 | 3.43 | 20.6 | $3.8 \times 10^6$ | 13.5 |
| 4 | 500 | 3.43 | 20.6 | $5.5 \times 10^6$ | 14.3 |
| 5 | 250 | 3.42 | 20.6 | $9.2 \times 10^7$ | 15.3 |
| AVG. | | | | $8.0 \times 10^6$ | 14.5 |
| Gas Phase [1] | | | | | 39.7 |
| 2% $Au/TiO_2$ [2] | | | | | 7.6 |
| 2.2% $Pd/Al_2O_3$ [3] | | | | | 9.6 |
| $Fe_2O_3$ [4] | | | | | 26.4 |
| $Fe_2O_3/TiO_2$ [5] | | | | | 19.4 |
| $Fe_2O_3/Al_2O_3$ [6] | | | | | 20.0 |

[1] See Bryden, K. M., and K. W. Ragland, Energy & Fuels, 10, 269 (1996).
[2] See Cant, N. W., N. J. Ossipoff, Catalysis Today, 36, 125, (1997).
[3] See Choi, K. I. and M. A. Vance, J. Catal., 131, 1, (1991).
[4] See Walker, J. S., G. I. Staguzzi, W. H. Manogue, and G. C. A. Schuit, J. Catal., 110, 299 (1988).
[5] Id.
[6] Id.

Figure 10:
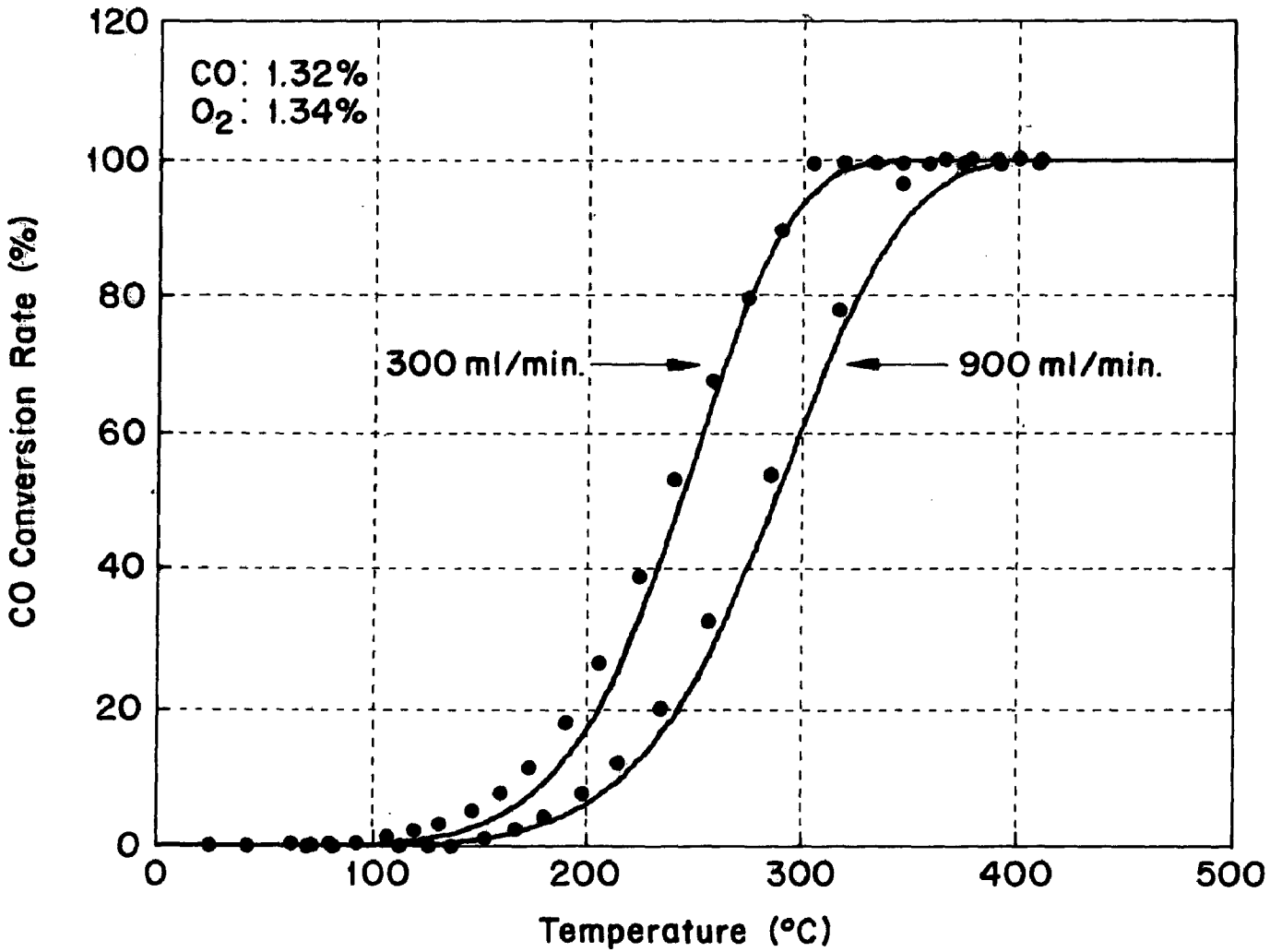
FIG. 10 depicts the temperature dependence for the conversion rate of carbon monoxide, for flow rates of 300 mL/min and 900 mL/min respectively.

FIG. 10 depicts the temperature dependence for the conversion rate of carbon monoxide using 50 mg $Fe_2O_3$ nanoparticles as catalyst in the quartz tube reactor, for flow rates of 300 mL/min and 900 mL/min respectively.

Figure 11:
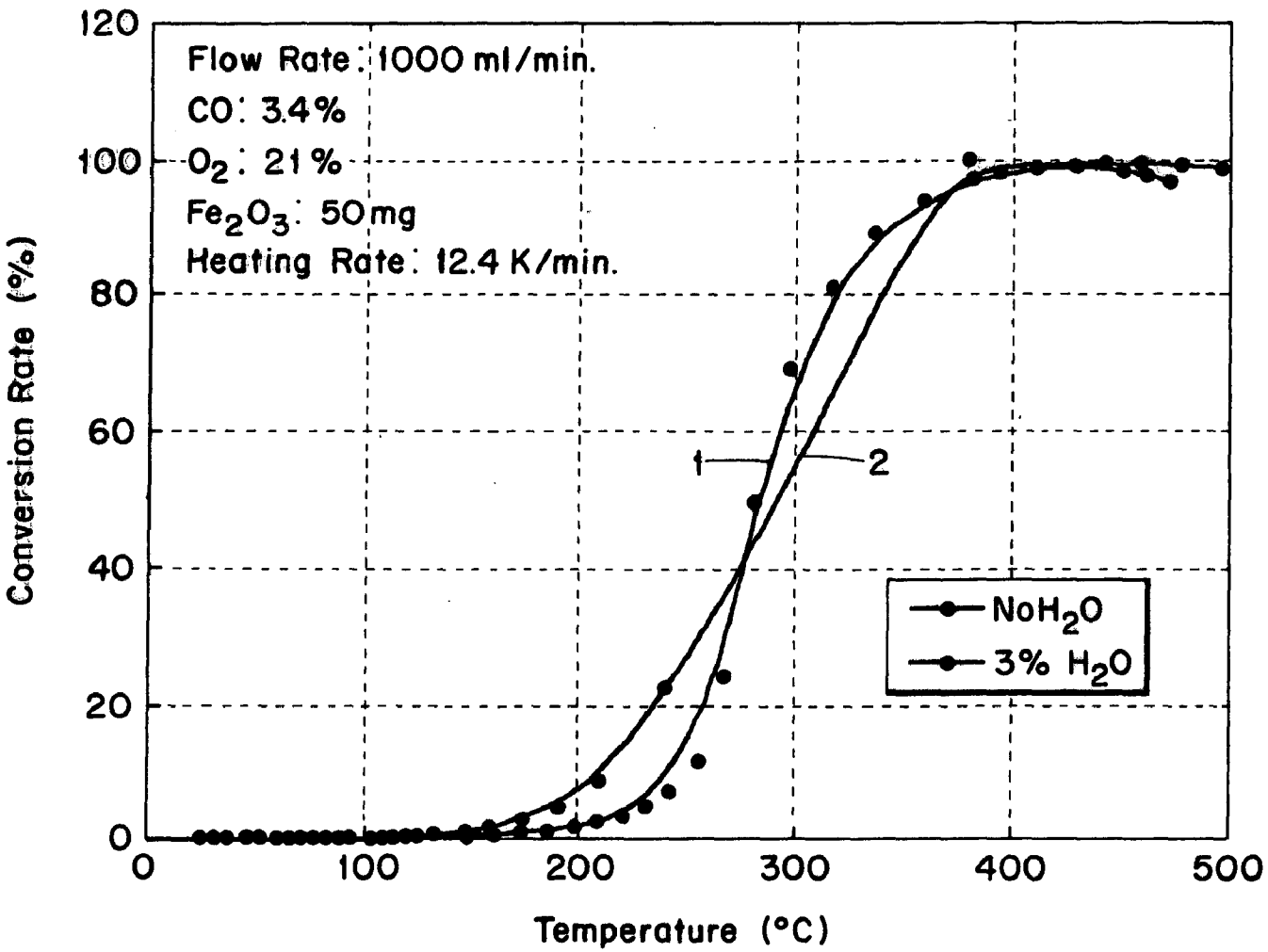
FIG. 11 depicts contamination and deactivation studies for water wherein curve 1 represents the condition for 3% $H_2O$ and curve 2 represents the condition for no $H_2O$.

FIG. 11 depicts contamination and deactivation studies for water using 50 mg $Fe_2O_3$ nanoparticles as catalyst in the quartz tube reactor. As can be seen from the graph, compared to curve 1 (without water), the presence of up to 3% water (curve 2) has little effect on the ability of $Fe_2O_3$ nanoparticles to convert carbon monoxide to carbon dioxide.

Figure 12:
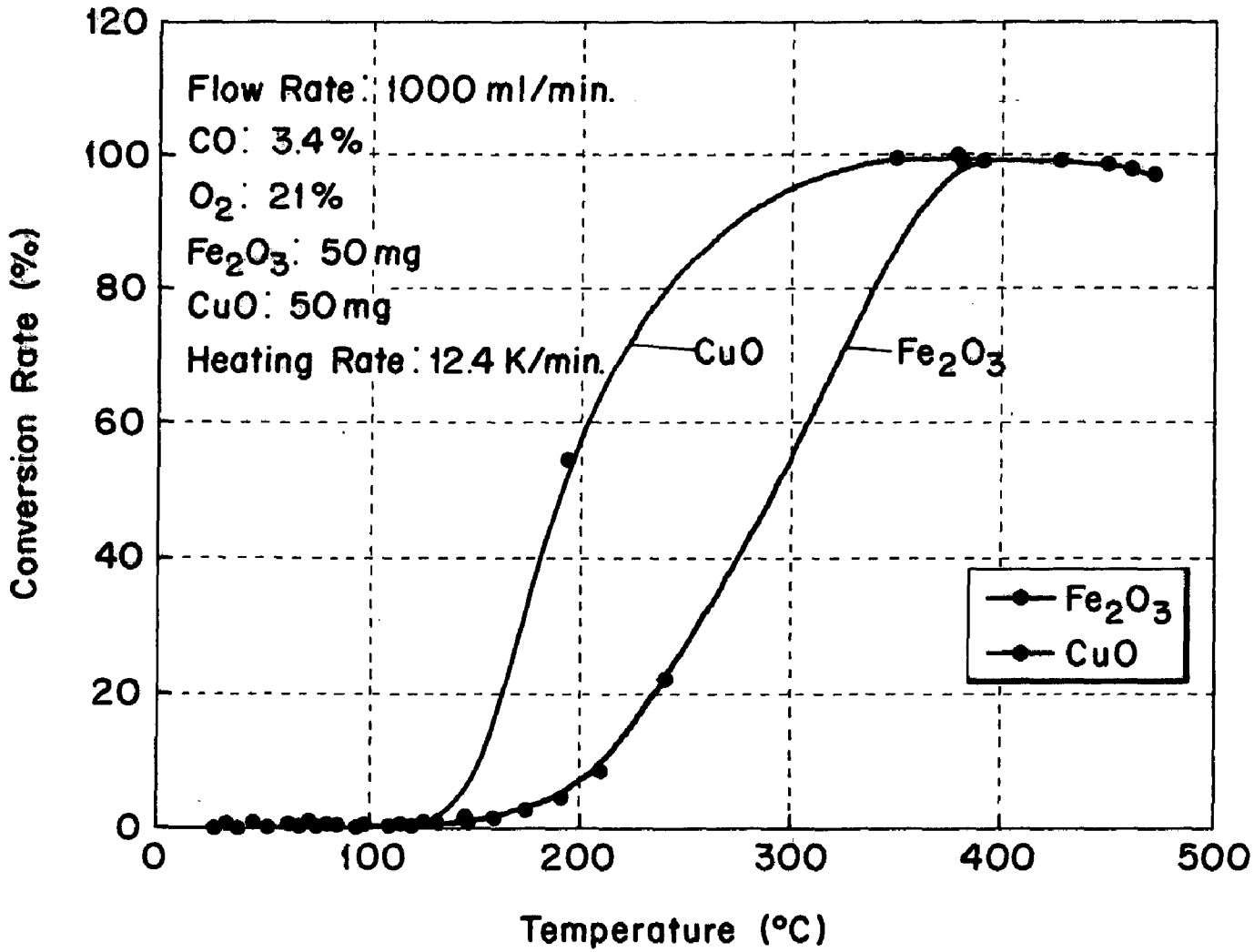
FIG. 12 depicts the temperature dependence for the conversion rates of CuO and $Fe_2O_3$ nanoparticles as catalysts for the oxidation of carbon monoxide with oxygen to produce carbon dioxide.

FIG. 12 illustrates a comparison between the temperature dependence of conversion rate for CuO and $Fe_2O_3$ nanoparticles using 50 mg $Fe_2O_3$ and 50 mg CuO nanoparticles as catalyst in the quartz tube reactor. Although the CuO nanoparticles have higher conversion rates at lower temperatures, at higher temperatures, the CuO and $Fe_2O_3$ have the same conversion rates.

Figure 13:
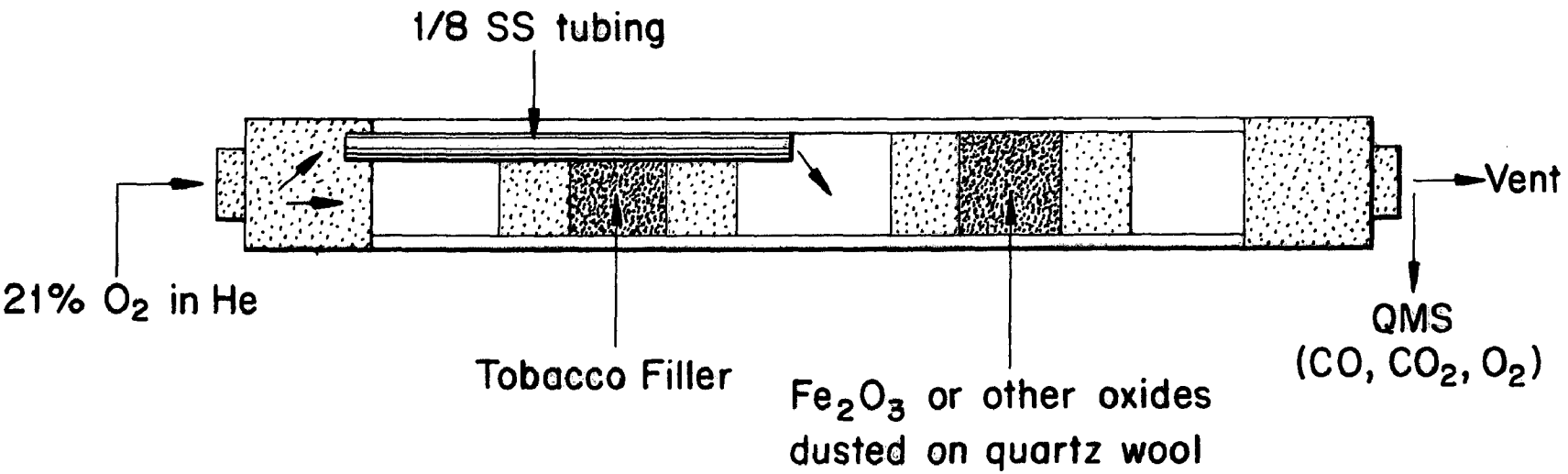
FIG. 13 depicts a flow tube reactor to simulate a cigarette in evaluating different nanoparticle catalysts.

FIG. 13 shows a flow tube reactor to simulate a cigarette in evaluating different nanopaticle catalysts. Table 2 shows a comparison between the ratio of carbon monoxide to carbon dioxide, and the percentage of oxygen depletion when using CuO, $Al_2O_3$, and $Fe_2O_3$ nanoparticles.

TABLE 2

Comparison between CuO, $Al_2O_3$, and $Fe_2O_3$ nanoparticles

| Nanoparticle | $CO/CO_2$ | $O_2$ Depletion (%) |
|---|---|---|
| None | 0.51 | 48 |
| $Al_2O_3$ | 0.40 | 60 |
| CuO | 0.29 | 67 |
| $Fe_2O_3$ | 0.23 | 100 |

In the absence of nanoparticles, the ratio of carbon monxide to carbon dioxide is about 0.51 and the oxygen depletion is about 48%. The data in Table 2 illustrates the improvement obtained by using nanoparticles. The ratio of carbon monoxide to carbon dioxide drops to 0.40, 0.29, and 0.23 for $Al_2O_3$, CuO and $Fe_2O_3$ nanoparticles, respectively. The oxygen depletion increases to 60%, 67% and 100% for $Al_2O_3$, CuO and $Fe_2O_3$ nanoparticles, respectively.

Figure 14:
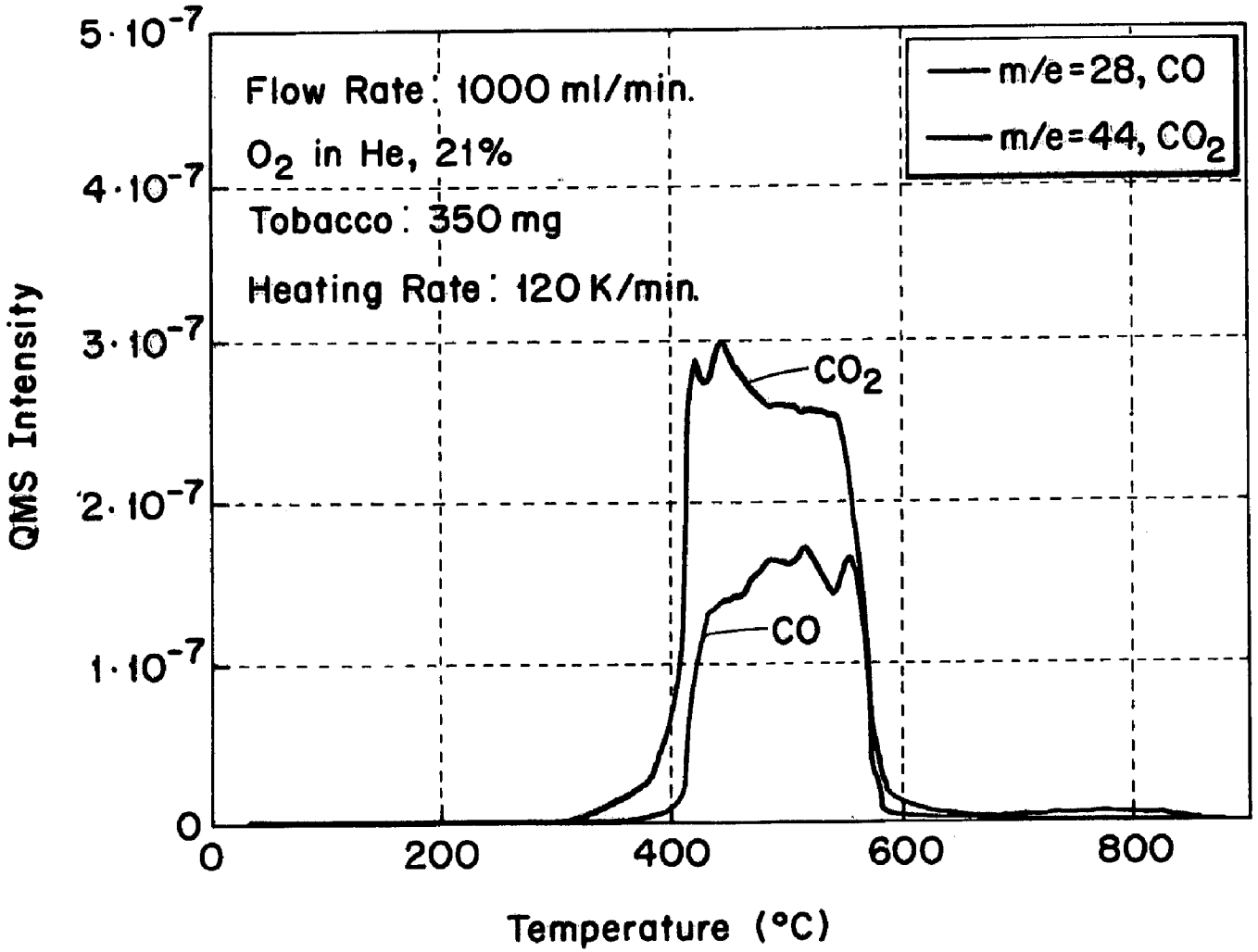
FIG. 14 depicts the relative amounts of carbon monoxide and carbon dioxide production without a catalyst present.
Figure 15:
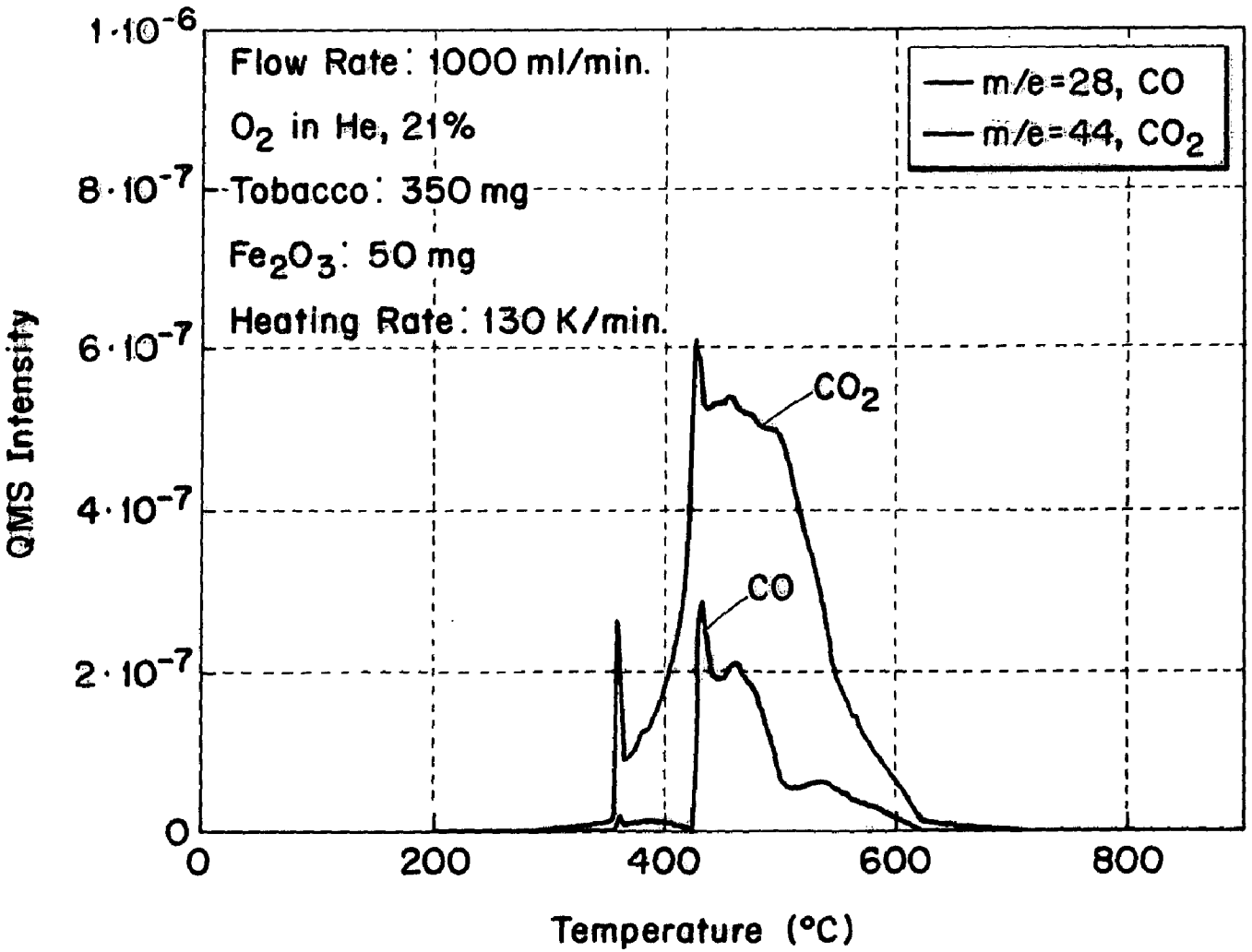
FIG. 15 depicts the relative amounts of carbon monoxide and carbon dioxide production with a catalyst present.

FIG. 14 is a graph of temperature versus QMS intensity in a test which shows the amounts of carbon monoxide and carbon dioxide production without a catalyst present. FIG. 15 is a graph of temperature versus QMS intensity in a test which shows the amounts of carbon monoxide and carbon dioxide production when using $Fe_2O_3$ nanoparticles as a catalyst. As can be seen by comparing FIG. 14 and FIG. 15, the presence of $Fe_2O_3$ nanoparticles increases the ratio of carbon dioxide to carbon monoxide present, and decreases the amount of carbon monoxide present.

In the absence of the $O_2$, $Fe_2O_3$ can also behave as a reagent to oxidize the CO to $CO_2$ with sequential reduction of the $Fe_2O_3$ to produce reduced phase such as $Fe_3O_4$, FeO and Fe. This property is useful in certain potential applications, such as a burning cigarette, where the $O_2$ is insufficient to oxidize all the CO present. The $Fe_2O_3$ can be used as a catalyst first, then again used as an oxidant and destroyed. In this way, the maximum amount of CO can be converted to $CO_2$ with only a minimal amount of $Fe_2O_3$ added.

The reaction of $Fe_2O_3$ with CO in absence of $O_2$ involves a number of steps. First, the $Fe_2O_3$ will be reduced stepwise to Fe, as the temperature increases, $$3Fe_2O_3+CO \leftrightarrows 2Fe_3O_4+CO_2 \quad (5)$$

$$2Fe_3O_4+2CO \leftrightarrows 6FeO+2CO_2 \quad (6)$$

$$6FeO+6CO \leftrightarrows 6Fe+6CO_2 \quad (7)$$

The total equation is:

$$Fe_2O_3+3CO \leftrightarrows 2Fe+3CO_2 \quad (8)$$

The proportions of CO consumed in these three steps described by equations (5), (6), and (7) are 1:2:6. The freshly formed Fe can catalyze the disproportional reaction of CO. The reaction produces $CO_2$ and a carbon deposit, $$2CO \leftrightarrows C+CO_2 \quad (9)$$

The carbon can also react with the Fe to form iron carbides, such as $Fe_3C$, and thus poisons the Fe catalyst. Once the Fe is completely transformed to iron carbide or its surface is completely covered by iron carbide or carbon deposit, then the disproportional reaction of CO stops.

Figure 16:
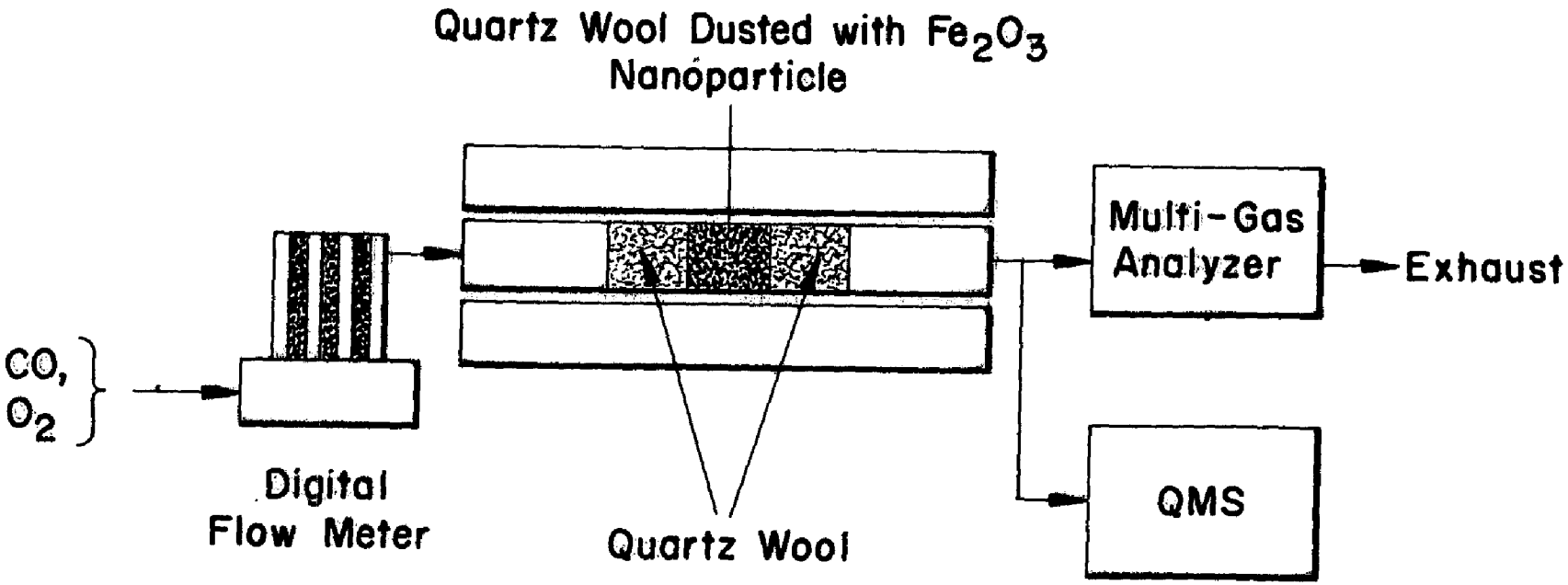
FIG. 16 depicts a flow tube reactor system with a digital flow meter and a multi-gas analyzer.
Figure 17:
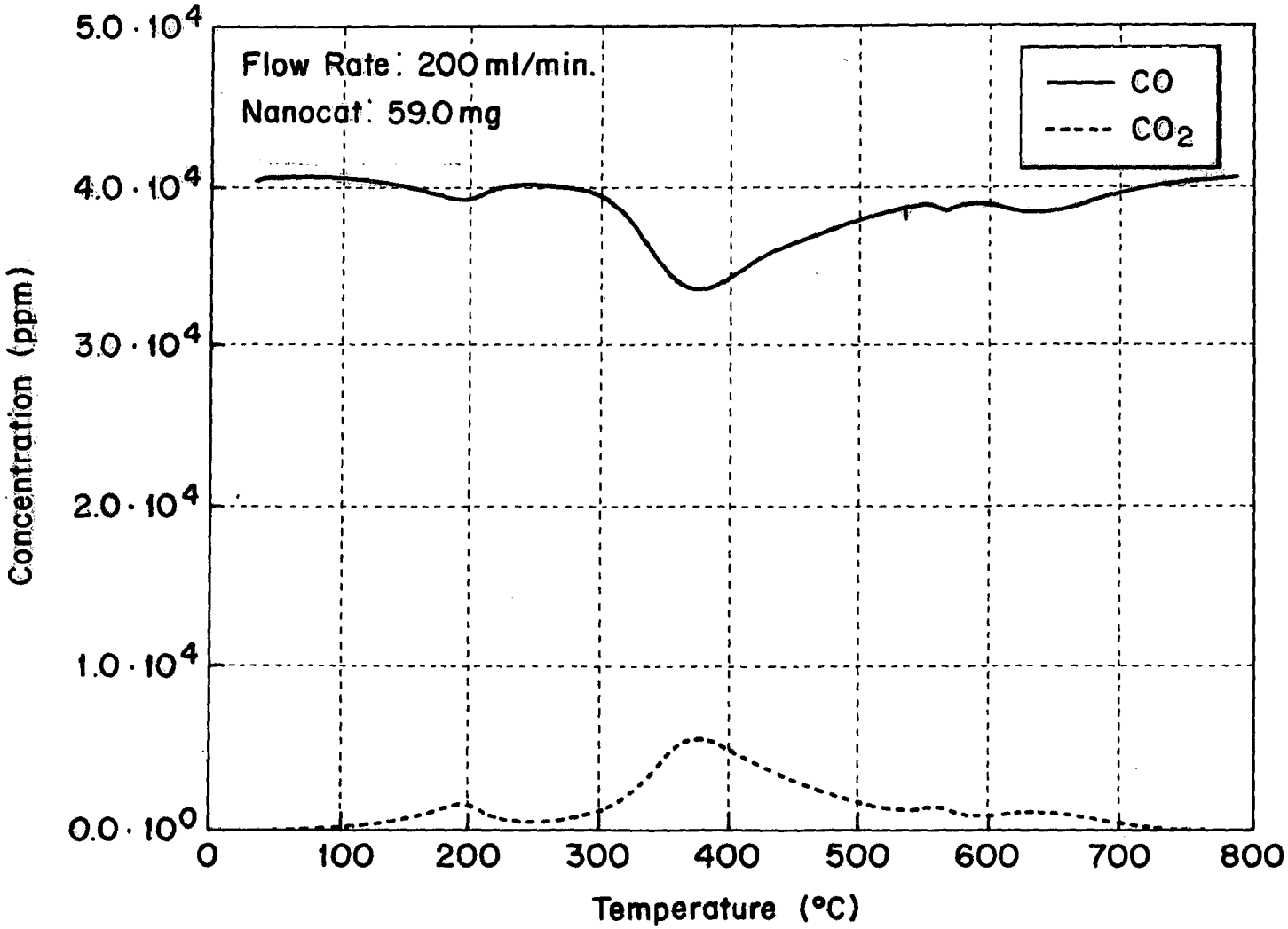
FIG. 17 depicts the production of $CO_2$ and the depletion of CO.
Figure 18:
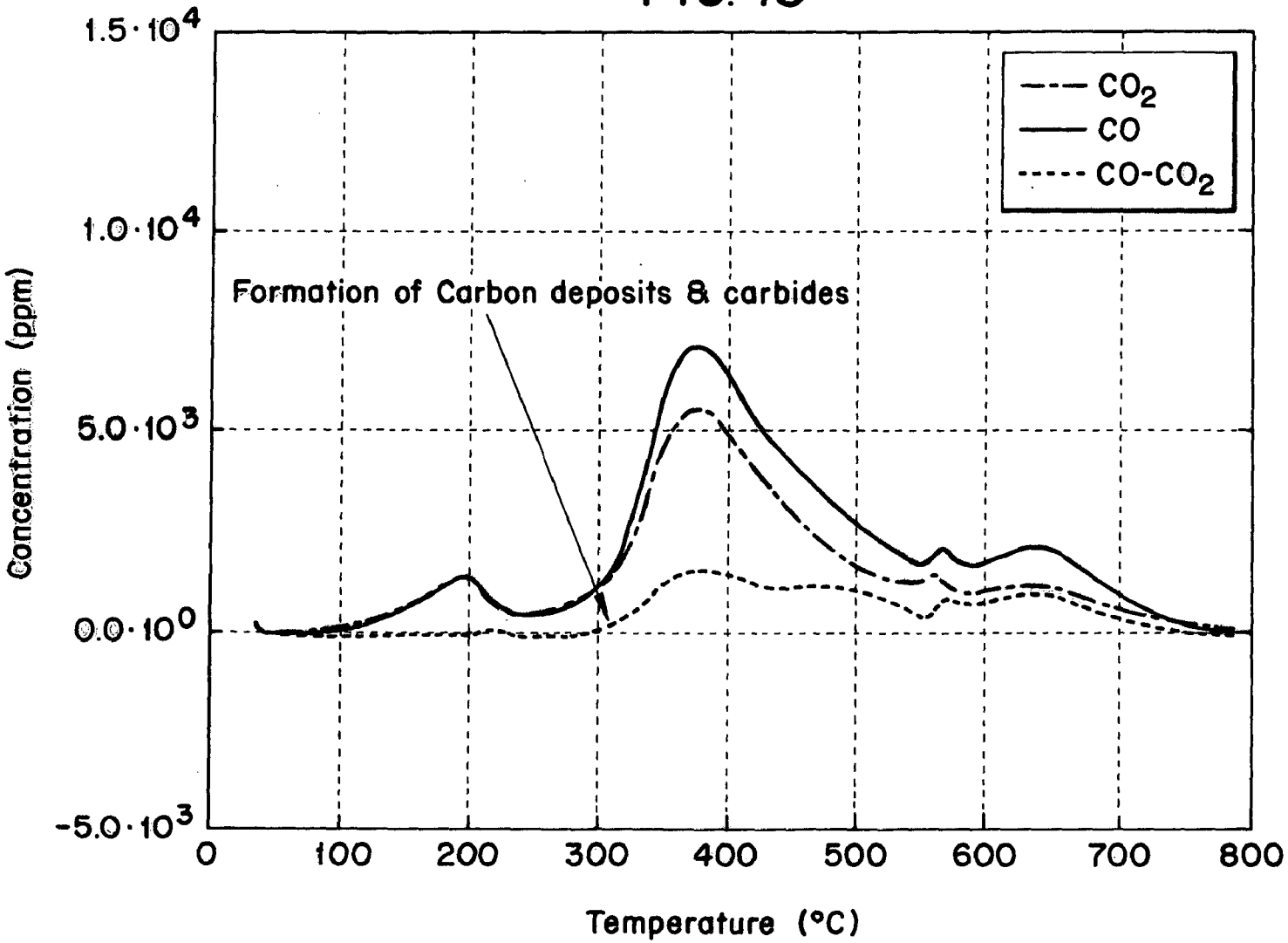
FIG. 18 depicts the depletion of CO and the production of $CO_2$, as well as the difference between the CO depletion and the $CO_2$ production, as indicated by the dashed line.

For the direct oxidation experiment, the quartz flow tube reactor shown in FIG. 16 was used. Only 4% CO balanced by helium was used in the gas inlet. The CO and $CO_2$ concentration were monitored in the effluent gas while the temperature was increased linearly from ambient to 800° C. The production of $CO_2$ and the depletion of CO are almost mirror images, as shown in FIG. 17. However, a more careful comparison in FIG. 18 shows that the depletion of CO and the production of $CO_2$ are not exactly overlapped. There is more CO depleted than $CO_2$ produced. The difference between the CO depletion and the $CO_2$ production, as indicated by the dashed line in FIG. 18, starts to appear at 300° C. and extends all the way to 800° C. All the CO reactions with different forms of iron oxides, as illustrated by equations (5), (6) and (7), would produce the same amount of $CO_2$ as the amount CO consumed. However, for the disproportionation reaction of CO catalyzed by the reduced forms of iron oxides as shown in equation (9), the CO consumed would be more than the $CO_2$ produced, and there should be carbon deposited on the surface.

Figure 19:
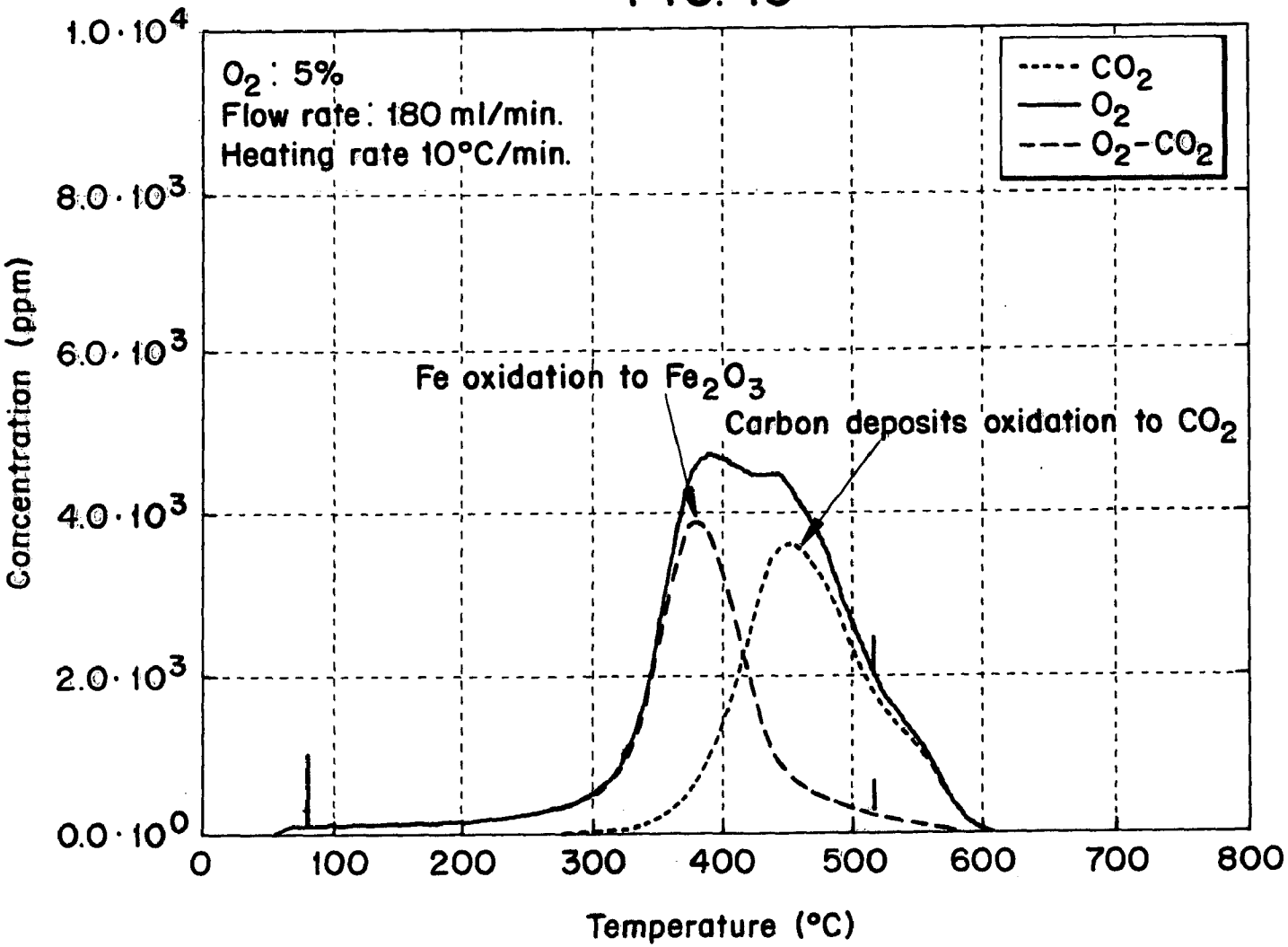
FIG. 19 depicts the net loss of $O_2$ and the production of the $CO_2$, and the difference between the amount of oxygen and the amount of carbon dioxide.

To confirm the existence of the carbon deposit, the reactor was first cooled down from 800° C. to room temperature under the inert atmosphere of helium gas. Then the inlet gas was switched to 5% of 02 in helium and the reactor temperature was again linearly ramped up to 800° C. The net loss of $O_2$, the production of the $CO_2$, and the difference between the amount of oxygen and the amount of carbon dioxide are shown in FIG. 19. The reactions that occurred are:

$$C+O_2 \leftrightarrows CO_2 \quad (10)$$

$$4Fe+3O_2 \leftrightarrows 2Fe_2O_3 \quad (11)$$

and/or $$4Fe_3C+13O_2 \leftrightarrows 6Fe_2O_3+4CO_2 \quad (12)$$

The production of $CO_2$ confirms the existence of the carbon in the sample. The difference between the net loss of $O_2$ and the production of $CO_2$ is the $O_2$ used to oxidize the Fe back to $Fe_2O_3$. This was also supported by the color change of the sample from black to bright red.

As further check, a sample heated to 800° C. in the presence of CO and He was quenched and examined with high-resolution TEM with energy dispersive spectroscopy. Essentially two phases were observed, and iron-rich phase and carbon. HRTEM images of $Fe_2O_3$ heated to 800° C. in the presence of CO show graphite surrounding iron carbide. The iron-rich phase formed a nucleus for the precipitation of carbon. The lattice fringes of the carbon have a 3.4 Å spacing, verifying that the carbon is graphite. The iron-rich core produced EDS spectra indicating only the presence of iron and carbon. Lattice fringes could be indexed as the metastable iron carbide $Fe_7C_3$ with Pnma symmetry. A hard mass was found on the bottom of the reactor table. Examination of this material in the TEM indicated that it consisted of a mixture of iron carbide, graphite, and essentially pure iron.

The CO disproportionation reaction is therefore effective in CO removal. A detailed stoichimetric account of the reduction and oxidation reactions is given in Table 3.

TABLE 3

The Stoichiometery of the CO + $Fe_2O_3$ Reaction (unit:mmole)

| Species | Measured | Theoretical | Description |
|---|---|---|---|
| | CO + $Fe_2O_3$ reaction | | |
| $Fe_2O_3$ | 0.344 | | 59.0 mg of NANOCAT ® $Fe_2O_3$ with 7% wt. of water, as measured by TG |
| $CO_{TOTAL}$ | 2.075 | | Total CO consumption |
| $CO_{2\ TOTAL}$ | 1.551 | | Total $CO_2$ production |
| $C = CO_{2\ TOTAL} - CO_{TOTAL}$ | 0.524 | | Total carbon in the residue |
| $CO_{2\ DISPROP.} = C$ | 0.524 | | $CO_2$ produced from the disproportional reaction according to equation (9) |
| $CO_{2\ Fe2O3} = CO_{2\ TOTAL} - CO_{2\ DISPROP.}$ | 1.027 | 1.032 | $CO_2$ produced according to equations (5), (6) and (7). |
| | $O_2$ + Fe, C Reaction | | |
| $O_{2\ TOTAL}$ | 1.060 | | Total oxygen consumption in the oxidation reaction. |

TABLE 3-continued

The Stoichiometery of the CO + $Fe_2O_3$ Reaction (unit:mmole)

| Species | Measured | Theoretical | Description |
|---|---|---|---|
| $CO_2$ | 0.564 | | $CO_2$ production from the oxidation of carbon deposit |
| $C = CO_2$ | 0.564 | | Total carbon content in the residues. |
| $O_{2\ Fe2O3} = O_{2\ TOTAL} - C$ | 0.496 | 0.516 | The oxygen used to oxidize Fe to $Fe_2O_3$. |

In the CO+$Fe_2O_3$ reaction, the difference between the total CO consumption ($CO_{TOTAL}$) and the total $CO_2$ production ($CO_{2,\ TOTAL}$) of 0.524 mmol can be attributed to the formation of the carbon deposits and iron carbides according to equation (9). This is in reasonable agreement with the 0.564 mmol determined by the oxidation of the reaction residue. The $CO_2$ produced from the reduction of $Fe_2O_3$ ($CO_{2,Fe2O3}$), is the difference between the $CO_{2,\ TOTAL}$ and the $CO_2$ produced from the CO disproportionation reaction ($CO_{2,\ DISPROP}$). The 1.027 mmol of $CO_{2,Fe2O3}$ agrees very well with the 1.032 mmol calculated from the initial amount of $Fe_2O_3$, according to equation (8). In the $O_2$+Fe, $Fe_3C$, and C oxidation reactions, the $O_2$ spent on the oxidation of the Fe species to $Fe_2O_3$ also agrees very well with the $O_2$ needed as calculated from the equations (11) and (12).

The total CO consumed ($CO_{TOTAL}$) of 2.075 mmol is more than double that of the CO consumed (1.027 mmol) by equation (8). Regarding the extra CO consumption, 50% became carbon deposits and carbides, and the other 50% became $CO_2$. Therefore, the contribution of the CO disproportionation reaction to the total CO removal is significant.

These experimental results show that NANOCAT® $Fe_2O_3$ is both a CO catalyst and a CO oxidant. As a catalyst, the reaction order is first order of CO and zero order for $O_2$. The apparent activation energy is 14.5 Kcal/mol. Due to its small particle size, the NANOCAT® $Fe_2O_3$ is an effective catalyst for CO oxidation, with a reaction rate of 19 $s^{-1}m^2$. In absence of $O_2$, the NANOCAT® $Fe_2O_3$ is an effective CO oxidant, as it can directly oxidize the CO to $CO_2$. In addition, during the direct oxidation process, the reduced form of NANOCAT® $Fe_2O_3$ catalyzed the disproportionation reaction of CO, producing carbon deposits, iron carbide and $CO_2$. The disproportionation reaction of CO contributes significantly to the total removal of CO.

Figure 20:
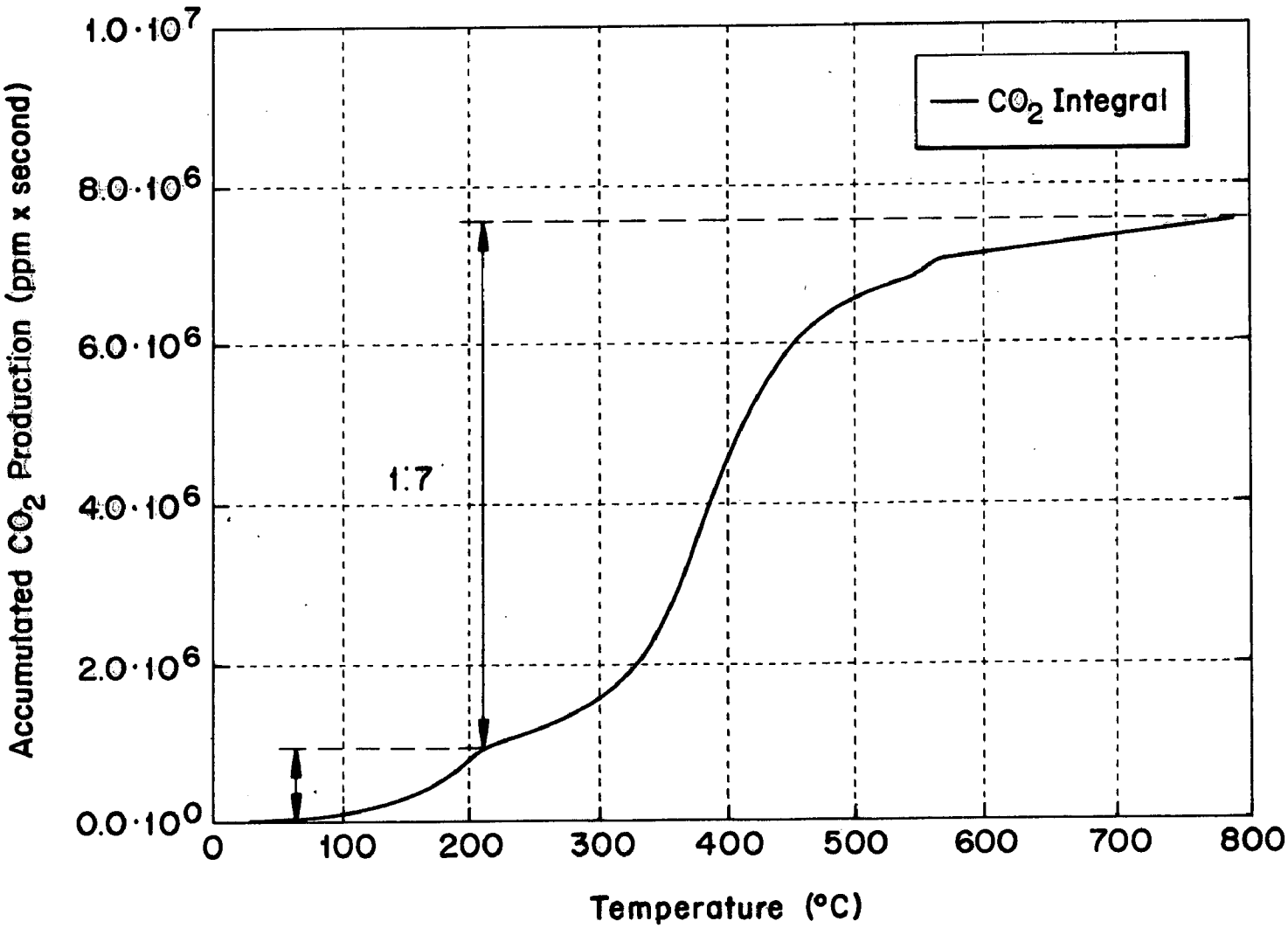
FIG. 20 depicts the expected stepwise reduction of NANOCAT® $Fe_2O_3$.

The amount of CO and NO can therefore be reduced by three potential reactions: the oxidation, catalysis or disproportionation. The expected stepwise reduction of NANOCAT® $Fe_2O_3$ is illustrated in FIG. 20. According to equations (5), (6) and (7), the ratio of $CO_2$ produced in these three steps is 1:2:6. However, in FIG. 20, only two steps can be observed with a ratio of approximately 1:7. Obviously, reactions (6) and (7) are not well separated. This is consistent with the observation that FeO is not a stable species.

Figure 21:
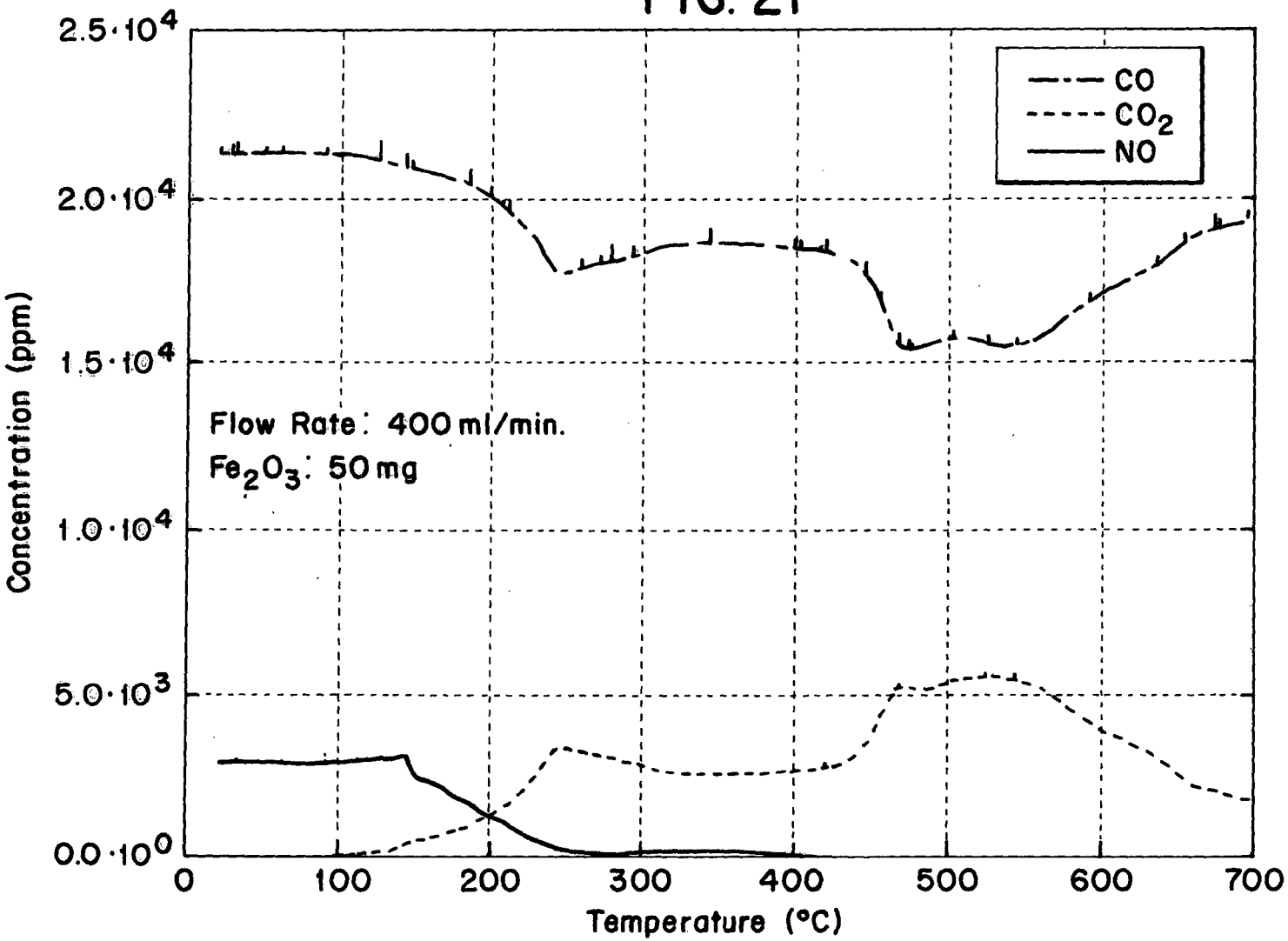
FIG. 21 depicts the conversion of carbon monoxide and nitric oxide to carbon dioxide and nitrogen.
Figure 22:
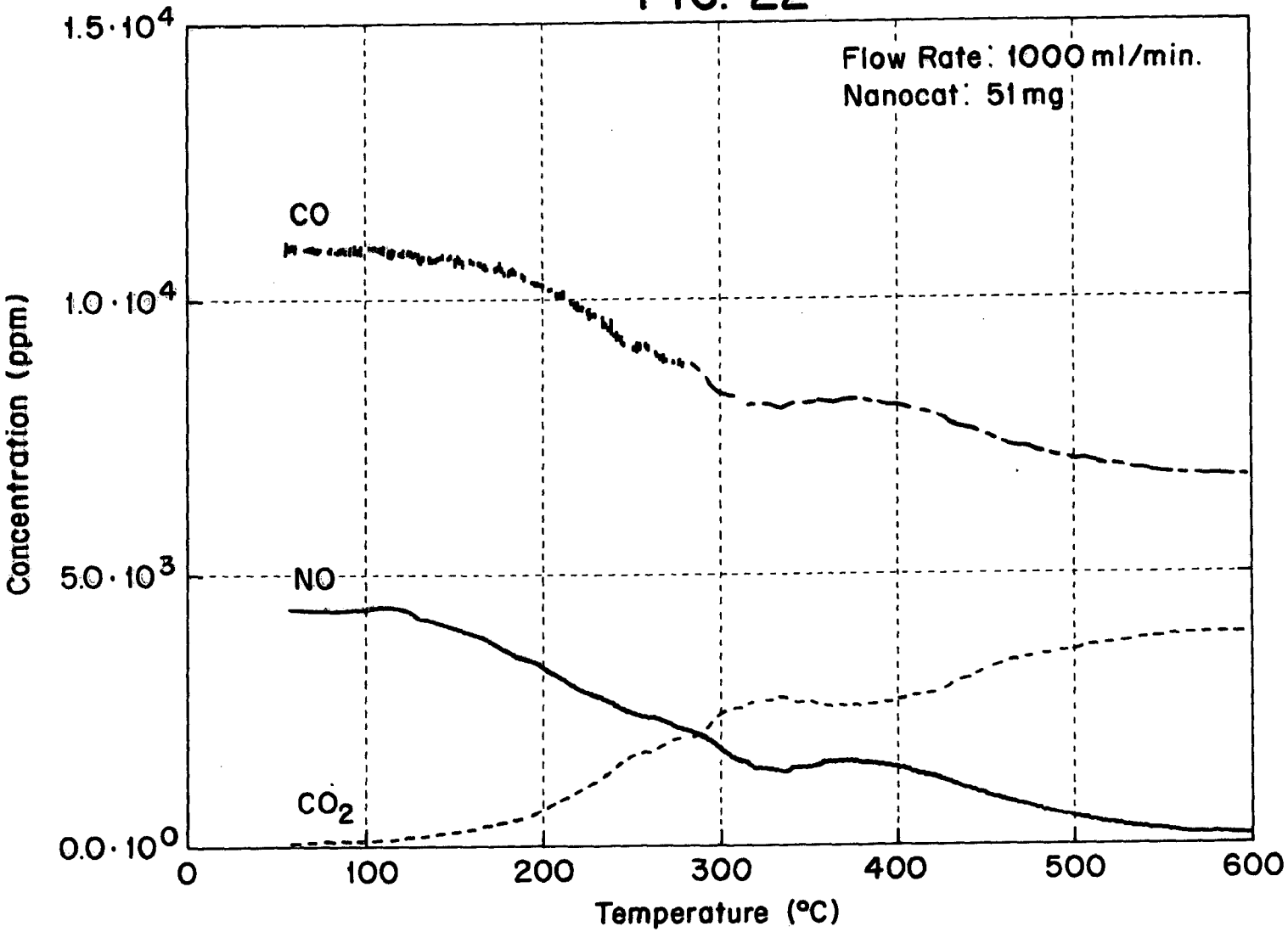
FIG. 22 depicts the concentrations of CO, NO, and $CO_2$ in the $2CO+2NO \leftrightarrows 2CO_2+N_2$ reaction without oxygen.
Figure 23:
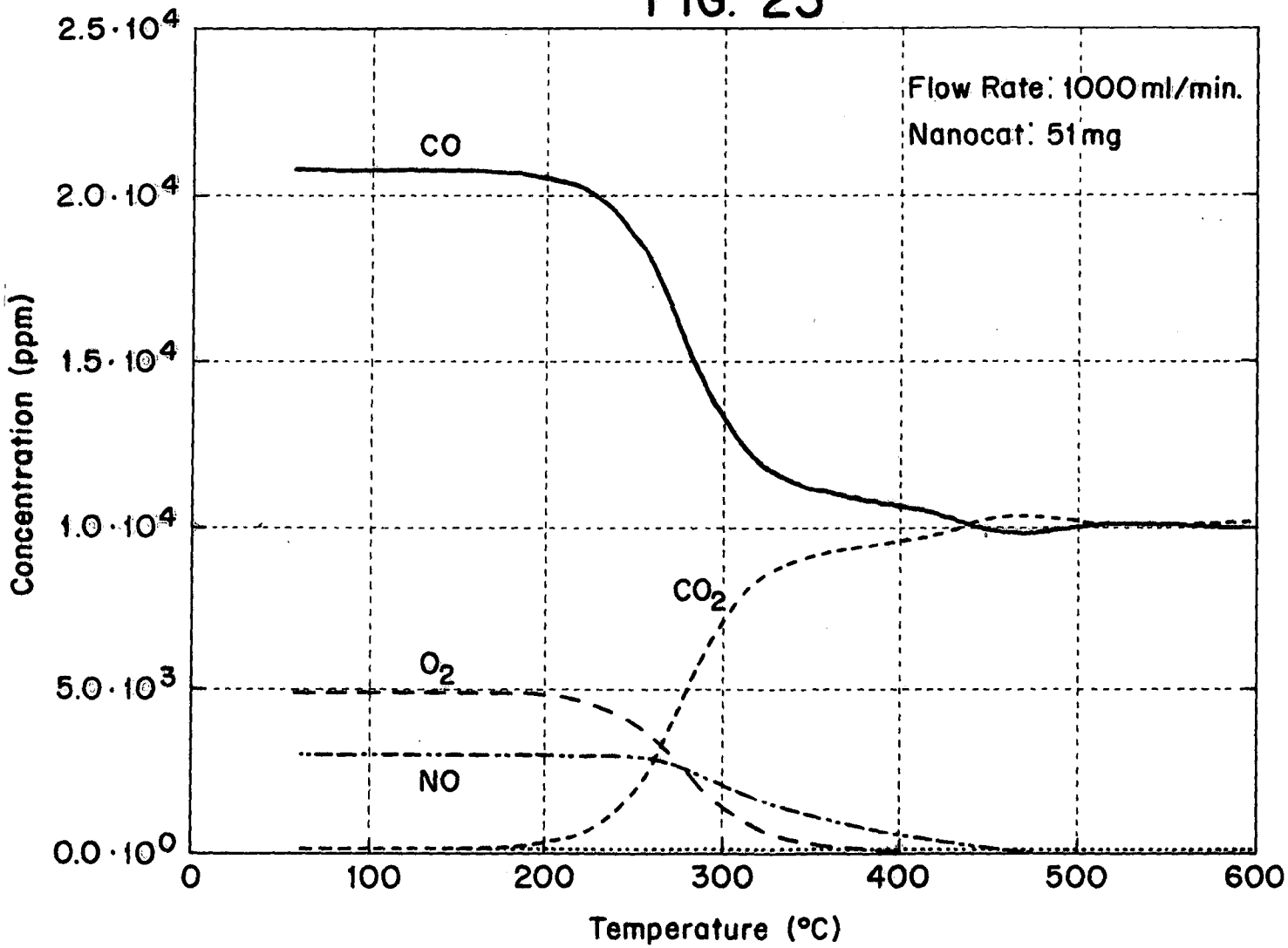
FIG. 23 depicts the concentrations of CO, NO, and $CO_2$ in the $2CO+2NO \leftrightarrows 2CO_2+N_2$ reaction when carried out under a low concentration of oxygen.
Figure 24:
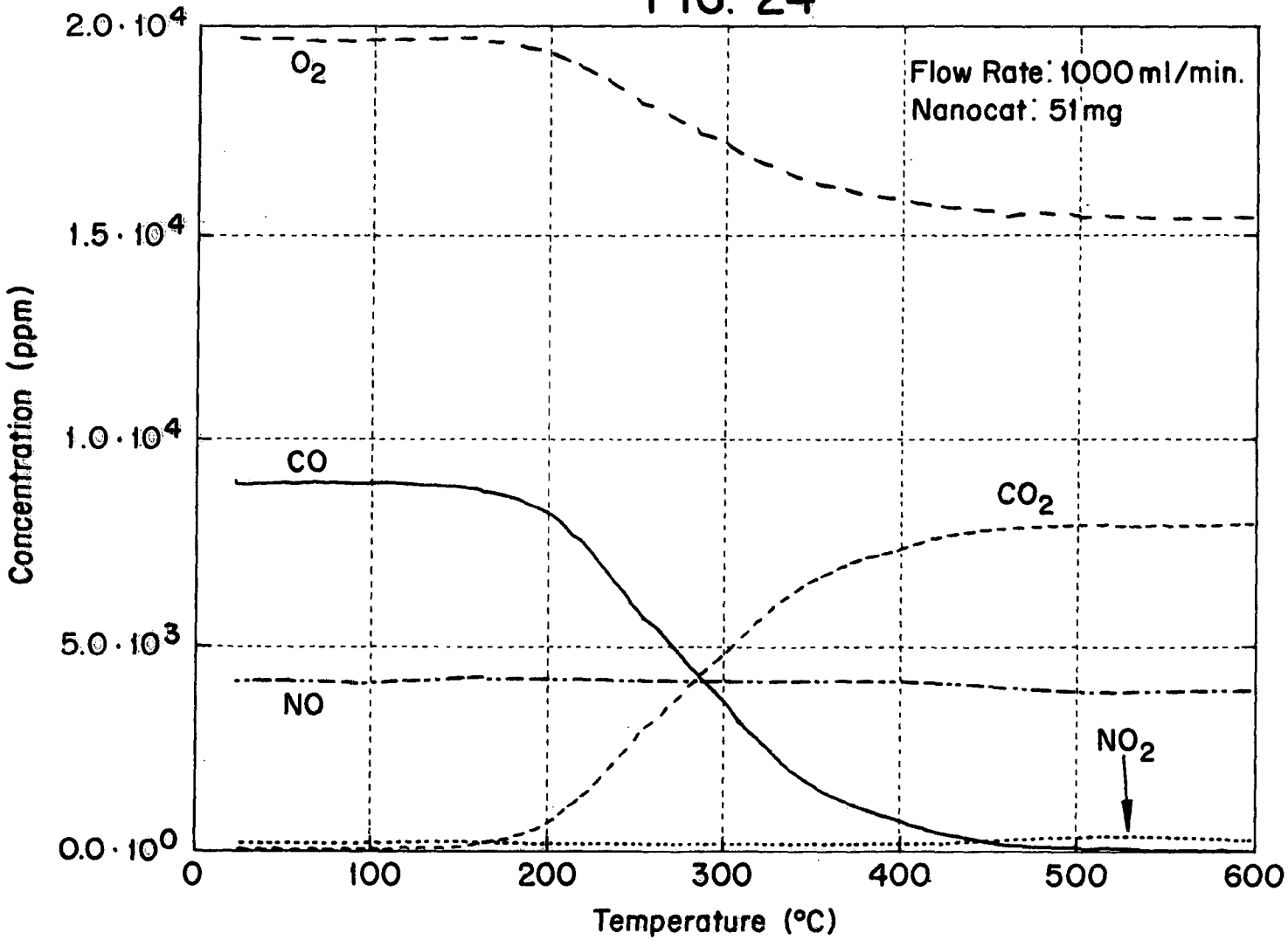
FIG. 24 depicts the concentrations of CO, NO, and $CO_2$ in the $2CO+2NO \leftrightarrows 2CO_2+N_2$ reaction when carried out under a high concentration of oxygen.

FIG. 21 shows the temperature dependence of the reaction of carbon monoxide and nitric oxide to carbon dioxide and nitrogen reaction. FIGS. 22–24 show the effect of iron oxide nanoparticles on a gas stream containing CO, NO and He. FIG. 22 depicts the concentrations of CO, NO, and $CO_2$ in the $2CO+2NO \leftrightarrows 2CO_2+N_2$ reaction without oxygen. FIG. 23 depicts the concentrations of these species when this reaction is carried out under a low concentration of oxygen and FIG. 24 depicts the concentrations when the reaction is carried out under a high concentration of oxygen. In the absence of any oxygen in the stream (as shown in FIG. 22), the reduction in NO concentration starts at about 120° C. By increasing the oxygen concentration (FIG. 23), the reduction in NO concentration shifts to about 260° C. At a higher level of oxygen (FIG. 24), the NO concentration remains unchanged. In all three cases, the catalyst is effective in reducing the CO concentration, but the reduced form of the catalyst is effective for the simultaneous removal of CO and NO.

The partially reduced nanoparticle additives, as described above, may be provided along the length of a tobacco rod by distributing the partially reduced nanoparticle additives on the tobacco or incorporating them into the cut filler tobacco using any suitable method. The nanoparticles may be provided in the form of a powder or in a solution in the form of a dispersion. In a preferred method, partially reduced nanoparticle additives in the form of a dry powder are dusted on the cut filler tobacco. The partially reduced nanoparticle additives may also be present in the form of a solution and sprayed on the cut filler tobacco. Alternatively, the tobacco may be coated with a solution containing the partially reduced nanoparticle additives. The partially reduced nanoparticle additive may also be added to the cut filler tobacco stock supplied to the cigarette making machine or added to a tobacco rod prior to wrapping cigarette paper around the cigarette rod.

The partially reduced nanoparticle additives will preferably be distributed throughout the tobacco rod portion of a cigarette and optionally the cigarette filter. By providing the partially reduced nanoparticle additives throughout the entire tobacco rod, it is possible to reduce the amount of carbon monoxide and/or nitric oxide throughout the cigarette, and particularly at both the combustion region and in the pyrolysis zone.

The amount of the partially reduced nanoparticle additive should be selected such that the amount of carbon monoxide and/or nitric oxide in mainstream smoke is reduced during smoking of a cigarette. Preferably, the amount of the partially reduced nanoparticle additive will be from about a few milligrams, for example, 5 mg/cigarette, to about 100 mg/cigarette. More preferably, the amount of partially reduced nanoparticle additive will be from about 40 mg/cigarette to about 50 mg/cigarette.

One embodiment of the invention relates to a cut filler composition comprising tobacco and at least one partially reduced nanoparticle additive, as described above, which is capable of acting as a catalyst for the conversion of carbon monoxide to carbon dioxide and/or a catalyst for the conversion of nitric oxide to nitrogen.

Any suitable tobacco mixture may be used for the cut filler. Examples of suitable types of tobacco materials include flue-cured, Burley, Md. or Oriental tobaccos, the rare or specialty tobaccos, and blends thereof. The tobacco material can be provided in the form of tobacco lamina; processed tobacco materials such as volume expanded or puffed tobacco, processed tobacco stems such as cut-rolled or cut-puffed stems, reconstituted tobacco materials; or blends thereof. The tobacco material may also include tobacco substitutes.

In cigarette manufacture, the tobacco is normally employed in the form of cut filler, i.e. in the form of shreds or strands cut into widths ranging from about 1/10 inch to about 1/20 inch or even 1/40 inch. The lengths of the strands range from between about 0.25 inches to about 3.0 inches. The cigarettes may further comprise one or more flavorants or other additives (e.g. burn additives, combustion modifying agents, coloring agents, binders, etc.) known in the art.

Another embodiment of the invention relates to a cigarette comprising a tobacco rod, wherein the tobacco rod comprises cut filler having at least one partially reduced nanoparticle additive, as described above, which is capable of acting as a catalyst for the conversion of carbon monoxide to carbon dioxide and/or a catalyst for the conversion of nitric oxide to nitrogen. A further embodiment of the invention relates to a method of making a cigarette, comprising (i) treating $Fe_2O_3$ nanoparticles with a reducing gas, so as to form at least one partially reduced additive capable of acting as a catalyst for the conversion of carbon monoxide to carbon dioxide and/or a catalyst for the conversion of nitric oxide to nitrogen, and wherein the partially reduced additive is in the form of nanoparticles; (ii) adding the partially reduced additive to a cut filler composition; (iii) providing the cut filler composition comprising the partially reduced additive to a cigarette making machine to form a tobacco rod; and (iv) placing a paper wrapper around the tobacco rod to form the cigarette.

Techniques for cigarette manufacture are known in the art. Any conventional or modified cigarette making technique may be used to incorporate the partially reduced nanoparticle additives. The resulting cigarettes can be manufactured to any known specifications using standard or modified cigarette making techniques and equipment. Typically, the cut filler composition of the invention is optionally combined with other cigarette additives, and provided to a cigarette making machine to produce a tobacco rod, which is then wrapped in cigarette paper, and optionally tipped with filters.

The cigarettes of the invention may range from about 50 mm to about 120 mm in length. Generally, a regular cigarette is about 70 mm long, a "King Size" is about 85 mm long, a "Super King Size" is about 100 mm long, and a "Long" is usually about 120 mm in length. The circumference is from about 15 mm to about 30 mm in circumference, and preferably around 25 mm. The packing density is typically between the range of about 100 $mg/cm^3$ to about 300 $mg/cm^3$, and preferably 150 $mg/cm^3$ to about 275 $mg/cm^3$.

Yet another embodiment of the invention relates to a method of smoking the cigarette described above, which involves lighting the cigarette to form smoke and drawing the smoke through the cigarette, wherein during the smoking of the cigarette, the partially reduced nanoparticle additive acts as a catalyst for the conversion of carbon monoxide to carbon dioxide and/or a catalyst for the conversion of nitric oxide to nitrogen.

"Smoking " of a cigarette means the heating or combustion of the cigarette to form smoke, which can be inhaled. Generally, smoking of a cigarette involves lighting one end of the cigarette and drawing the cigarette smoke through the mouth end of the cigarette, while the tobacco contained therein undergoes a combustion reaction. However, the cigarette may also be smoked by other means. For example, the cigarette may be smoked by heating the cigarette and/or heating using electrical heater means, as described in commonly-assigned U.S. Pat. Nos. 6,053,176; 5,934,289; 5,591,368 or 5,322,075, for example.

While the invention has been described with reference to preferred embodiments, it is to be understood that variations and modifications may be resorted to as will be apparent to those skilled in the art. Such variations and modifications are to be considered within the purview and scope of the invention as defined by the claims appended hereto.

All of the above-mentioned references are herein incorporated by reference in their entirety to the same extent as if each individual reference was specifically and individually indicated to be incorporated herein by reference in its entirety.

The invention claimed is:

1. A method of making a cigarette, comprising:

treating $Fe_2O_3$ nanoparticles with a reducing gas, so as to convert the $Fe_2O_3$ nanoparticles to $Fe_3O_4$ nanoparticles capable of acting a catalyst for the conversion of carbon monoxide to carbon dioxide and/or a catalyst for the conversion of nitric oxide to nitrogen;

adding the $Fe_3O_4$ nanoparticles to a cut filler composition;

providing the cut filler composition comprising the $Fe_3O_4$ nanoparticles to a cigarette making machine to form a tobacco rod; and placing a paper wrapper around the tobacco rod to form the cigarette.

2. A method of reducing nitric oxide in tobacco smoke produced by a cigarette, comprising:

lighting the cigarette to form smoke and drawing the smoke through the cigarette, wherein the cigarette comprises a tobacco rod comprising a cut filler composition having tobacco and at least one partially reduced additive capable of acting as a catalyst for the conversion of nitric oxide to nitrogen, and wherein the partially reduced additive is $Fe_3O_4$ nanoparticles formed by partially reducing $Fe_2O_3$ nanoparticles before lighting the cigarette, wherein the $Fe_3O_4$ has an average particle size of about 3 nm.

3. The method of claim 2, wherein $Fe_2O_3$ nanoparticles are partially reduced to form the $Fe_3O_4$ nanoparticles before forming the tobacco rod.

4. The method of claim 3, wherein the $Fe_3O_4$ is further reduced in situ to form at least one reduced species of FeO or Fe.

5. The method of claim 2, wherein the $Fe_3O_4$ is sized and is present in an amount effective to convert at least about 50% of the carbon monoxide to carbon dioxide.

6. The method of claim 5, wherein the $Fe_3O_4$ is sized and is present in an amount effective to convert at least about 80% of the carbon monoxide to carbon dioxide.

7. The method of claim 2, wherein the $Fe_3O_4$ is sized and is present in an amount effective to convert at least about 50% of the nitric oxide to nitrogen.

8. The method of claim 7, wherein the $Fe_3O_4$ is sized and is present in an amount effective to convert at least about 80% of the nitric oxide to nitrogen.

9. The method of claim 2, wherein the cigarette preferably has about 5 mg to about 100 mg $Fe_3O_4$ nanoparticles per cigarette.

10. The method of claim 2, wherein the cigarette preferably has about 40 mg to about 50 mg $Fe_3O_4$ nanoparticles per cigarette.

11. The method of claim 2, wherein the $Fe_3O_4$ has an average particle size less than about 50 nm.

12. The method of claim 2, wherein the $Fe_3O_4$ has an average particle size less than about 5 nm.

* * * * *